US010571858B2

(12) United States Patent
Kawamura et al.

(10) Patent No.: US 10,571,858 B2
(45) Date of Patent: Feb. 25, 2020

(54) IMAGE FORMING APPARATUS AND CONFIGURATION OF CARTRIDGE UNIT

(71) Applicant: CANON KABUSHIKI KAISHA, Tokyo (JP)

(72) Inventors: Tomofumi Kawamura, Suntou-gun (JP); Shoichi Zensai, Yokohama (JP); Takamichi Matsuo, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/140,126

(22) Filed: Sep. 24, 2018

(65) Prior Publication Data

US 2019/0094796 A1 Mar. 28, 2019

(30) Foreign Application Priority Data

Sep. 28, 2017 (JP) ..... 2017-189096

(51) Int. Cl.

*G03G 21/18* (2006.01)
*G03G 15/00* (2006.01)
*G03G 15/08* (2006.01)

(52) U.S. Cl.

CPC ..... *G03G 21/186* (2013.01); *G03G 15/081* (2013.01); *G03G 15/757* (2013.01); *G03G 21/185* (2013.01); *G03G 21/1857* (2013.01); *G03G 15/5008* (2013.01); *G03G 2221/1657* (2013.01)

(58) Field of Classification Search

CPC .. G03G 21/186; G03G 15/757; G03G 15/081; G03G 2221/1657; G03G 15/5008; G03G 21/185; G03G 21/1864; G03G 15/0896; G03G 21/1857

See application file for complete search history.

(56) References Cited

U.S. PATENT DOCUMENTS 6,400,914 B1 * 6/2002 Noda ..... F16D 1/101 399/111
7,236,722 B2 * 6/2007 Portig ..... G03G 21/1647 399/121
2015/0160608 A1 6/2015 Sawashima (Continued)

FOREIGN PATENT DOCUMENTS

EP 0329145 A2 * 8/1989 ..... G03G 15/757
EP 2259156 A2 12/2010

(Continued)

*Primary Examiner* — David M. Gray
*Assistant Examiner* — Laura Roth
(74) *Attorney, Agent, or Firm* — Canon USA, Inc., IP Division

(57) ABSTRACT

An image forming apparatus including a cartridge and an apparatus main body to which the cartridge is detachably attachable is disclosed. The apparatus main body includes a driving force transmitting member, an output member, and a biasing member disposed between the output member and the driving force transmitting member. The driving force transmitting member is caused to rotate relative to the output member in the predetermined rotation by the biasing member, when an engagement between the driving force transmitting member and the driving force receiving member is released by a detachment of the cartridge from the apparatus main body.

7 Claims, 21 Drawing Sheets

(56) References Cited

U.S. PATENT DOCUMENTS

| | | | | |
|---|---|---|---|---|
| 2016/0209783 | A1* | 7/2016 | Chino | G03G 21/1647 |
| 2017/0248171 | A1* | 8/2017 | Kawamura | F16D 11/14 |
| 2017/0351214 | A1* | 12/2017 | Uesugi | G03G 15/00 |
| 2018/0239299 | A1* | 8/2018 | Zhou | G03G 21/1647 |

FOREIGN PATENT DOCUMENTS

| | | | |
|---|---|---|---|
| EP | 3173869 | A1 | 5/2017 |
| JP | 05-027765 | U | 4/1993 |
| JP | 2008-145877 | A | 6/2008 |
| WO | 2016/137014 | A1 | 9/2016 |

* cited by examiner

IMAGE FORMING APPARATUS AND CONFIGURATION OF CARTRIDGE UNIT

BACKGROUND OF THE INVENTION

Field of the Invention

The present disclosure relates to an electrophotographic system image forming apparatus.

Description of the Related Art

In an electrophotographic system image forming apparatus, a configuration is known in which elements such as: a photosensitive drum, serving as a rotating member related to image formation; and a development roller, are formed integrally into a cartridge, which is detachably attachable to an image forming apparatus main body (hereinafter, referred to as an apparatus main body). In such a configuration, since the photosensitive drum in the cartridge is rotated, many apparatuses employ a configuration in which driving force is provided from the apparatus main body.

A configuration that transmits driving force by engaging a driving force transmitting member, which includes a plurality of first engagement portions (engaged portions) on an apparatus main body side, and a coupling member, serving as a driving force receiving member including a plurality of second engaging portions (engaging portions) on a cartridge side, to each other is known.

International Publication No. WO2016/137014A1 discloses a configuration that includes a drive shaft serving as a driving force transmitting member including recesses serving as a plurality of first engagement portions on an outer peripheral surface, and a coupling member serving as a driving force receiving member including a plurality of second engaging portions movable in a radial direction. In such a configuration, driving force is transmitted by having the second engaging portions enter and engage with the recesses (the first engagement portions).

Errors may exist in the driving force transmitting member and the driving force receiving member due, for example, to manufacturing errors. Accordingly, depending on the relative phase relationship between the driving force transmitting member and the driving force receiving member, only some of the first engagement portions and some of the second engaging portions may be engaged with each other. When rotation is performed in such a partially engaged state, since force concentrates on only some of the first engagement portions and some of the second engaging portions, rotational accuracy of the driving force receiving member becomes poor. Accordingly, an image defect may occur during the image-forming period. Furthermore, since force is concentrated on only some of the first engagement portions and some of the second engaging portions, the driving force transmitting member and the driving force receiving member may become damaged.

SUMMARY OF THE INVENTION

A first aspect of the claimed disclosure is an image forming apparatus that forms an image on a recording material, the image forming apparatus including a cartridge including a rotating member and a driving force receiving member that is rotatable together with the rotating member and is arranged to receive driving force for rotating the rotating member, and an apparatus main body to which the cartridge is detachably attachable, the apparatus main body including, a driving force transmitting member arranged to rotate and transmit the driving force to the driving force receiving member, an output member rotatable about an axis arranged coaxially with that of the driving force transmitting member, the output member being arranged to transmit the driving force to the driving force transmitting member and to have play between itself and the driving force transmitting member in a rotation direction of the driving force transmitting member, and a biasing member disposed between the output member and the driving force transmitting member, the biasing member biasing the driving force transmitting member in a predetermined rotation direction relative to the output member. In the image forming apparatus, one of the driving force transmitting member and the driving force receiving member includes a plurality of engaging portions, and the other of the driving force transmitting member and the driving force receiving member includes a plurality of engaged portions, the plurality of engaging portions and the plurality of engaged portions engaging with each other so that the driving force transmitting member and the driving force receiving member engage with each other, in a case where the cartridge is mounted in the apparatus main body the driving force transmitting member and the driving force receiving member are arranged to engage with each other, resulting in a rotation of the driving force transmitting member in the predetermined rotation direction causes the rotating member to rotate, and in a case that the cartridge is detached from the apparatus main body and an engagement between the driving force transmitting member and the driving force receiving member is released, the driving force transmitting member is caused to rotate relative to the output member in the predetermined rotation direction by biasing force of the biasing member.

Further features of the present invention will become apparent from the following description of exemplary embodiments with reference to the attached drawings. Each of the embodiments of the present invention described below can be implemented solely or as a combination of a plurality of the embodiments. Also, features from different embodiments can be combined where necessary or where the combination of elements or features from individual embodiments in a single embodiment is beneficial.

DESCRIPTION OF THE EMBODIMENTS

First Exemplary Embodiment

Overview of Electrophotographic Image Forming Apparatus

Figure 1:
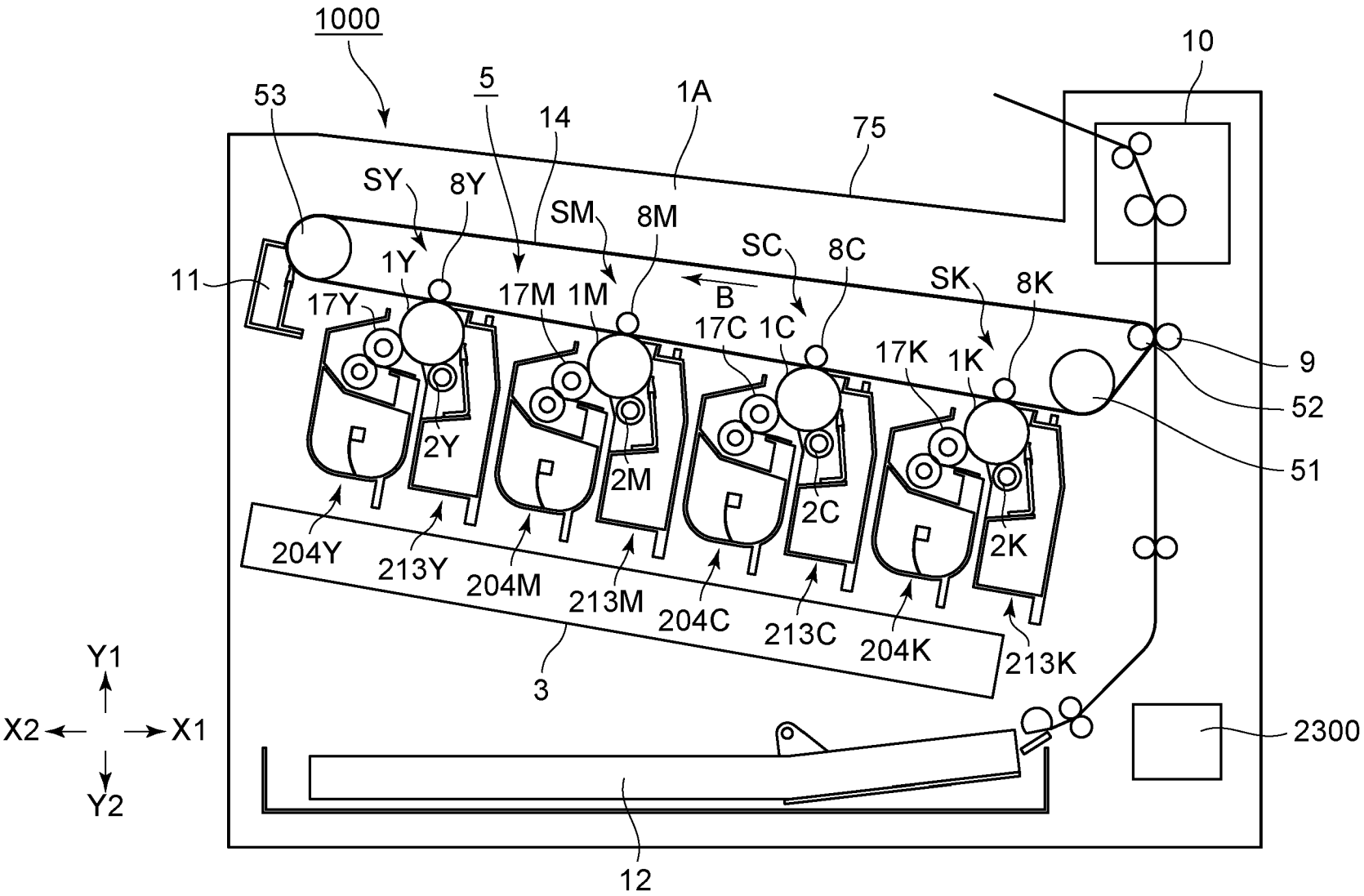
FIG. 1 is a cross-sectional view schematically illustrating an image forming apparatus.

Referring first to FIG. 1, an overall configuration of an electrophotographic image forming apparatus (an image forming apparatus) according to an exemplary embodiment will be described. FIG. 1 is a cross-sectional view schematically illustrating an image forming apparatus 1000 of the present exemplary embodiment. As illustrated in FIG. 1, the image forming apparatus 1000 includes first, second, third, and fourth image forming units SY, SM, SC, and SK serving as a plurality of image forming units that form images of yellow (Y), magenta (M), cyan (C), and black (K), respectively. In the present exemplary embodiment, the first to fourth image forming units SY, SM, SC, and SK are arranged in a line in a substantially horizontal direction.

Configurations and movements of drum cartridges (first cartridges) 213 (213Y, 213M, 213C, and 213K) are practically the same, and configurations and movements of developing cartridges (second cartridges) 204 (204Y, 204M, 204C, and 204K) are practically the same. The difference among the four drum cartridges 213 and the difference among the four developing cartridges 204 are the colors of the formed images. Accordingly, hereinafter, when the components do not need to be distinguished, Y, M, C, and K will be omitted, and description thereof will be given in a summative manner.

In the present exemplary embodiment, the image forming apparatus 1000 includes cylinders (hereinafter, photosensitive drums) 1 serving as a plurality of image carrying members that are aligned in a parallel manner in a direction slightly inclined against the vertical direction and that include four photosensitive layers. A scanner unit (exposing device) 3 is disposed below the drum cartridges 213 and the developing cartridges 204 in the gravitational direction. Furthermore, charge rollers 2 and other members serving as process members that act on the photosensitive layers are disposed on circumferences of the photosensitive drums 1.

The charge rollers 2 are charging members (charging devices) that uniformly charge surfaces of the photosensitive drums 1. Furthermore, the scanner unit (the exposing device) 3 is an exposure member (an exposing device) that projects laser beams on the photosensitive drums 1 based on image information to form electrostatic images (electrostatic latent images) on the photosensitive drums 1. Cleaning blades 6 serving as cleaning members (cleaning devices) and the developing cartridges 204 are disposed on the circumferences of the photosensitive drums 1.

Each of the drum cartridges 213 and each of the developing cartridges 204 can be independently mounted in and dismounted from an apparatus main body 1A. In other words, either some or all of the developing cartridges 204 can be mounted in or dismounted from the apparatus main body 1A while in a state in which either some or all of the drum cartridges 213 are mounted in the apparatus main body 1A. Furthermore, either some or all of the drum cartridges 213 can be mounted in or dismounted from the apparatus main body 1A while in a state in which either some or all of the developing cartridges 204 are mounted in the apparatus main body 1A.

Furthermore, an intermediate transfer belt 5 serving as an intermediate transfer member that transfers toner images on the photosensitive drums 1 to a recording material (a sheet or a recording medium) 12 is disposed so as to oppose the four photosensitive drums 1. The developing cartridges 204 of the present exemplary embodiment uses a nonmagnetic one-component developer (hereinafter, toner) as the developer, and employs a contact developing method in which development rollers 217 serving as developer carrying members are in contact with the photosensitive drums 1.

In the configuration described above, toner images formed on the photosensitive drums 1 are transferred onto a sheet (paper) 12, and the toner images transferred on the sheet are fixed. Furthermore, the drum cartridges 213 include, as process members that act on the photosensitive drums 1, the charge rollers 2 that charge the photosensitive drums 1, and the cleaning blades 6 that removes toner that has not been transferred and that is remaining on the photosensitive drums 1. The untransferred residual toner remaining on the photosensitive drums 1 without being transferred onto the sheet 12 is collected by the cleaning blades 6. Furthermore, the untransferred residual toner collected by the cleaning blades 6 is accommodated in removed developer accommodating portions (hereinafter referred to as waste toner accommodating portions) 214*a* through openings 214*b*. Each waste toner accommodating portion 214*a* and the corresponding cleaning blade 6 are formed in an integral manner and constitute the corresponding drum cartridge 213.

Furthermore, the apparatus main body 1A includes guides (positioning members) such as mount guides and positioning members (not shown). The developing cartridges 204 and the drum cartridges 213 are guided with the guides described above and are configured to be detachably attachable to the apparatus main body 1A. The developing cartridges 204 for various colors accommodate yellow (Y) toner, magenta (M) toner, cyan (C) toner, and black (K) toner.

The intermediate transfer belt 5 abuts against the photosensitive drums 1 included in the drum cartridges 213, and rotates (moves) in an arrow B direction in FIG. 1. The intermediate transfer belt 5 is stretched across a plurality of supporting members (a drive roller 51, an opposing roller 52 for secondary transfer, and a driven roller 53). Four primary transfer rollers 8 serving as primary transfer members are arranged side by side on the inner peripheral surface side of the intermediate transfer belt 5 so as to oppose the photosensitive drums 1. Furthermore, a secondary transfer roller 9 serving as a secondary transfer member is disposed on the outer peripheral surface side of the intermediate transfer belt 5 so as to oppose the opposing roller 52 for secondary transfer.

Referring next to FIG. 1, a method of forming an image will be described. The surfaces of the photosensitive drums 1 are uniformly charged first by applying a bias to the charge rollers 2 from a bias-charging power supply (not shown) inside an image forming apparatus main body. Subsequently, scanning exposure is performed on the charged surfaces of the photosensitive drums 1 with laser beams emitted from a scanner unit 3 according to image information. With the above, electrostatic latent images corresponding to the image information are formed on the photosensitive drums 1. The electrostatic latent images formed on the photosensitive drums 1 are developed as toner images with the developing cartridges 204. The toner images formed on the photosensitive drums 1 are transferred (primarily transferred) onto the intermediate transfer belt 5 with the work of the primary transfer rollers 8.

For example, when a full-color image is formed on a recording material, the process described above is sequentially performed with the four drum cartridges 213 (213Y, 213M, 213C, and 213K) and the four developing cartridges 204 (204Y, 204M, 204C, and 204K). Subsequently, the toner images of various colors formed on the photosensitive drums 1 of the drum cartridges 213 are primarily transferred onto the intermediate transfer belt 5 in a sequential manner so as to be laid over each other. Subsequently, synchronizing with the movement of the intermediate transfer belt 5, the recording material 12 is conveyed to a secondary transfer unit. Then, the four-colored toner images on the intermediate transfer belt 5 are transferred, all at once, onto the recording material 12 that has been conveyed to the secondary transfer unit formed by the intermediate transfer belt 5 and the secondary transfer roller 9.

The recording material 12 on which the toner images have been transferred is conveyed to a fixing device 10 serving as a fixing member. The toner images are fixed to the recording material 12 by having heat and pressure applied to the recording material 12 in the fixing apparatus 10. Furthermore, primary-transfer untransferred residual toner, which is toner that has remained on the photosensitive drums 1 after the primarily transferring step, is removed by the cleaning blades 6 and is collected as waste toner. Furthermore, secondary-transfer untransferred residual toner, which is toner that has remained on the intermediate transfer belt 5 after the secondarily transferring step, is removed by an intermediate transfer belt cleaning device 11. The image forming apparatus 1000 performs image formation on the recording material in the above manner.

Note that the image forming apparatus 1000 is capable of forming a desired monochromatic or multicolor image on the recording material by using one of or some (not all) of the image forming units.

Schematic Configurations of Drum Cartridges and Developing Cartridges

Figure 2A:
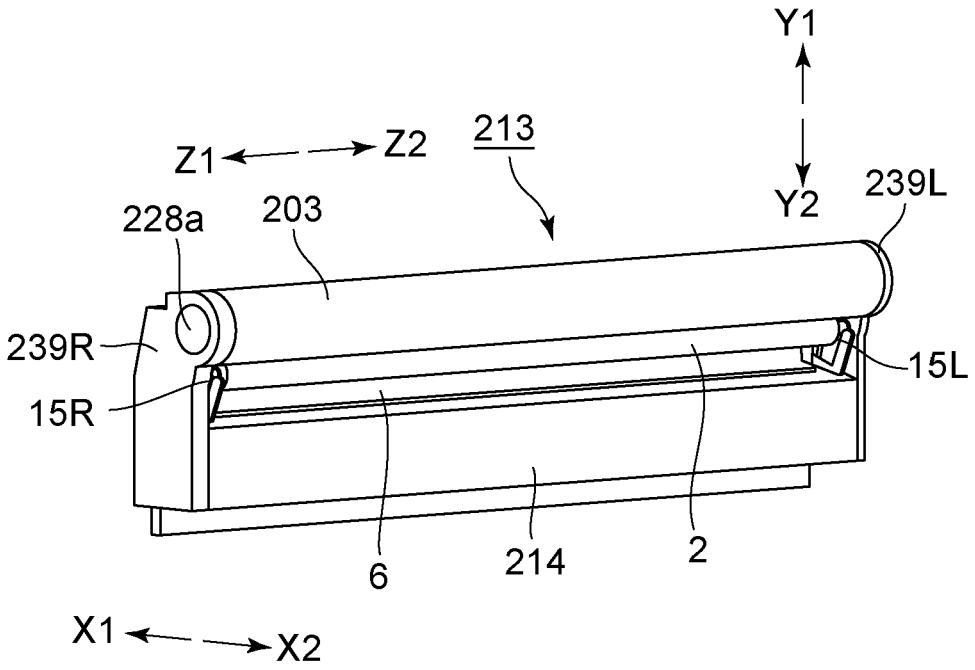
FIG. 2A is an external perspective view of a drum cartridge and FIG. 2B is a cross-sectional view of the drum cartridge.
Figure 2B:
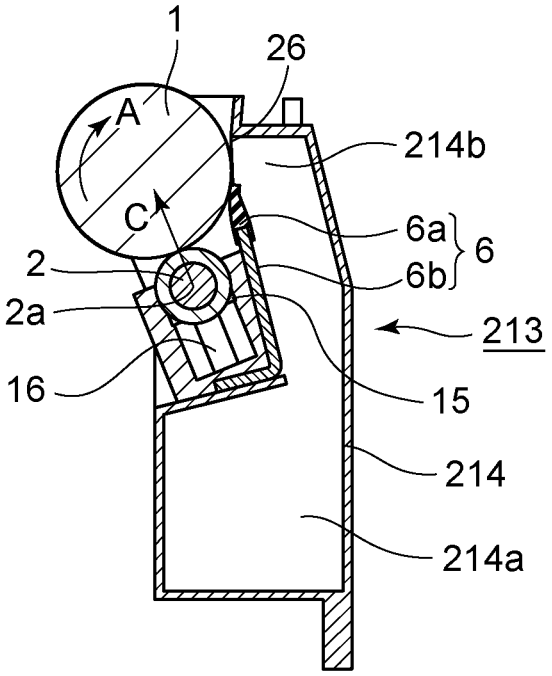
Figure 3A:
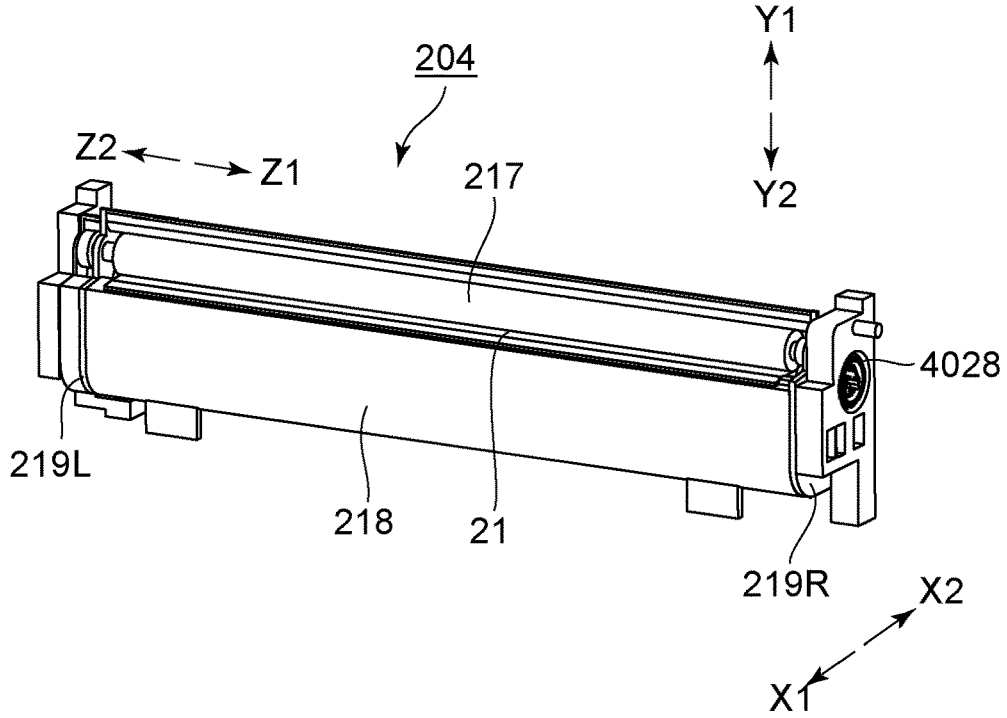
FIG. 3A is an external perspective view of a developing cartridge and FIG. 3B is a cross-sectional view of the developing cartridge.
Figure 3B:
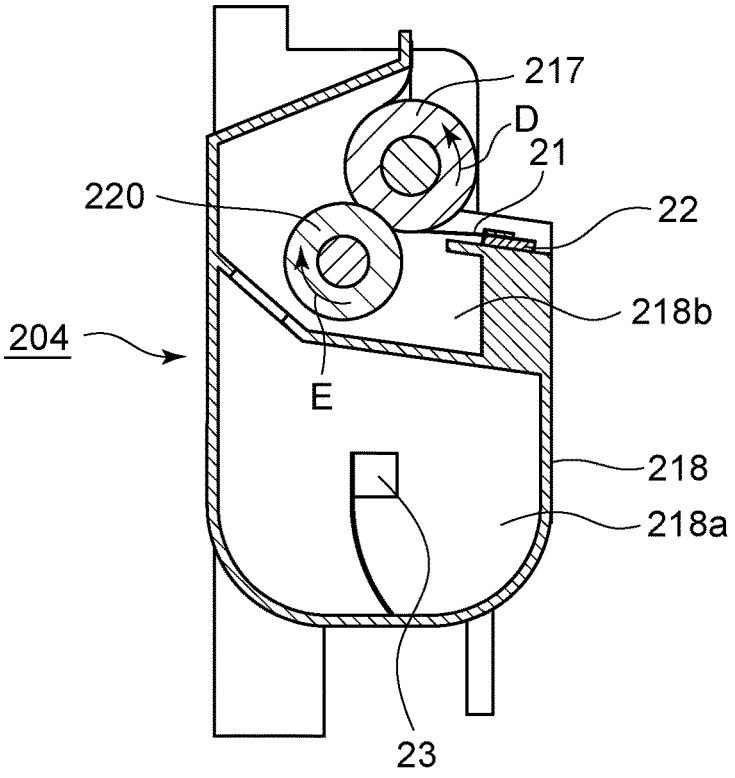
Figure 4:
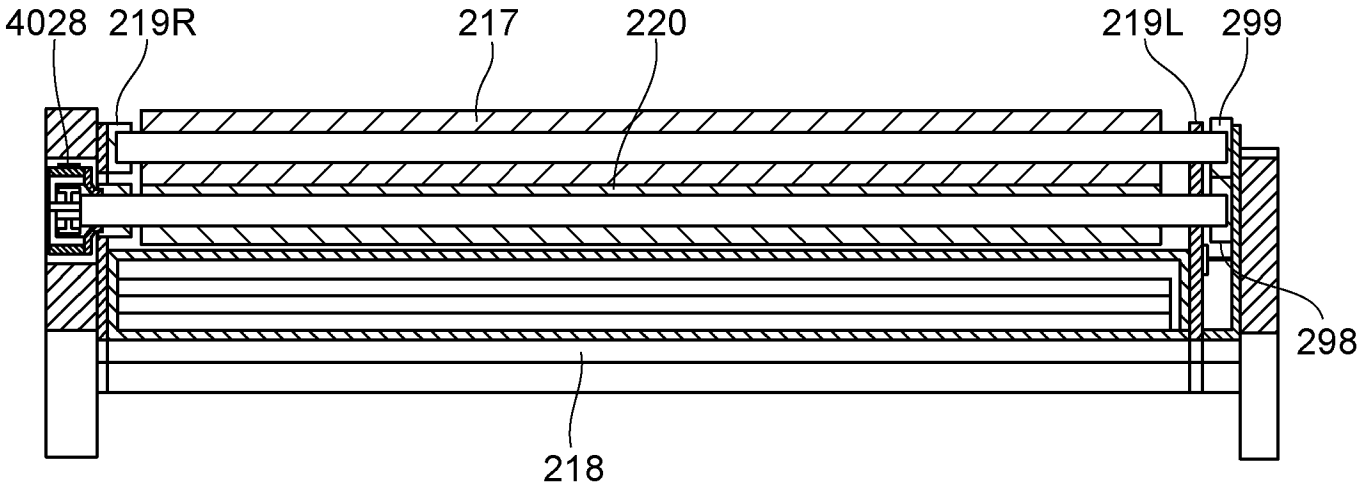
FIG. 4 is cross-sectional view illustrating a drive configuration of the developing cartridge.

Schematic configurations of the drum cartridges 213 (213Y, 213M, 213C, and 213K) and the developing cartridges 204 (204Y, 204M, 204C, and 204K) that are mounted in the apparatus main body 1A illustrated in FIG. 1 will be described with reference to FIGS. 2A, 2B, 3A, 3B, and 4. FIG. 1 is a schematic cross-sectional view of the image forming apparatus 1000. FIG. 2A is an external perspective view of the drum cartridge 213. FIG. 2B is a cross-sectional view of the drum cartridge 213. FIG. 3A is an external perspective view of the developing cartridge 204. FIG. 3B is a cross-sectional view of the drum cartridge 204. FIG. 4 is a cross-sectional view illustrating a drive configuration of the developing cartridge 204. The section of the cross-sectional view is parallel to an axial line of the development roller 217.

Note that the drum cartridge 213Y, the drum cartridge 213M, the drum cartridge 213C, and the drum cartridge 213K have the same configuration. Furthermore, other than the difference in the color of the toner, the developing cartridge 204Y, the developing cartridge 204M, the developing cartridge 204C, and the developing cartridge 204K have the same configuration. The developing cartridge 204Y contains yellow toner, the developing cartridge 204M contains magenta toner, the developing cartridge 204C contains cyan toner, and the developing cartridge 204K contains black toner. Accordingly, in the description hereinafter, description will be given while the drum cartridges 213Y, 213M, 213C, and 213K are collectively referred to as the drum cartridges 213, and the developing cartridges 204Y, 204M, 204C, and 204K are collectively referred to as the developing cartridges 204. Similarly, the components of the cartridges will be referred to in a collective manner as well.

FIG. 2A is the external perspective view of the drum cartridge 213. As illustrated in FIG. 2A, a rotational axis direction of the photosensitive drum 1 is referred to as a Z direction (arrow Z1 and arrow Z2). A horizontal direction in FIG. 1 is referred to as an X direction (arrow X1 and arrow X2) and a vertical direction in FIG. 1 is referred to as a Y direction (arrow Y1 and arrow Y2).

Each photosensitive drum 1 is rotatably supported, at both ends thereof, by drum unit bearing members 239R and 239L. A coupling member 228*a* is attached, as a flange, to a drive-side end portion of the photosensitive drum 1 and rotates with the photosensitive drum 1 in an integrated manner. The drum unit bearing members 239R and 239L are attached to both ends of a cleaner frame 214 and support a photosensitive drum unit 203. With the above, the photosensitive drum unit 203 is rotatably supported by the cleaner frame 214.

Furthermore, the charge roller 2 and the cleaning blade 6 are attached to the cleaner frame 214 and are disposed so as to be in contact with the surface of the photosensitive drum 1. Furthermore, charge roller bearings 15 are attached to the cleaner frame 214. The charge roller bearings 15 are bearings that support a shaft of the charge roller 2.

Note that the charge roller bearings 15 are attached so as to be movable in an arrow C direction illustrated in FIG. 2B. A rotating shaft 2*a* of the charge roller 2 is rotatably attached to the charge roller bearings 15. Furthermore, the charge roller bearing 15 is biased towards the photosensitive drum 1 with a pressure applying spring 16 serving as a biasing member. With the above, the charge roller 2 is abutted against the photosensitive drum 1 and, following the rotation of the photosensitive drum 1, is rotated by the photosensitive drum 1.

Each cleaner frame 214 is provided with the corresponding cleaning blade 6 serving as a cleaning member that removes the toner remaining on the surface of the corresponding photosensitive drum 1. The cleaning blade 6 is an integrated member of a blade-shaped rubber (an elastic member) 6*a* that abuts against the photosensitive drum 1 and that removes the toner on the photosensitive drum 1, and a supporting plate 6*b* that supports the blade-shaped rubber 6*a*. In the present exemplary embodiment, the supporting plate 6*b* is attached to the cleaner frame 214 with a screw.

As described above, the cleaner frame 214 includes the opening 214*b* that collects the untransferred residual toner collected with the cleaning blade 6. The opening 214*b* is provided with a blowout prevention sheet 26 that abuts against the photosensitive drum 1 and that seals between the photosensitive drum 1 and the opening 214*b*. The blowout prevention sheet 26 prevents the toner from leaking from the opening 214*b* in the upper direction.

FIG. 3A is the external perspective view of the developing cartridge 204. The developing cartridges 204 each include a developer frame 218 that supports various elements. The developing cartridge 204 is provided with the development roller 217 serving as a developer carrying member that rotates in an arrow D direction (a counterclockwise direction) illustrated in FIG. 3B. The development rollers 217 are rotatably supported at both end portions thereof in a longitudinal direction (a rotational axis direction) by the developer frame 218 with developer bearings 219 (219R and 219L) interposed therebetween. Note that the developer bearings 219 (219R and 219L) are attached to two side portions of the developer frame 218. The development roller 217 in contact with the photosensitive drum 1 adheres the developer onto the photosensitive drum 1, and develops the latent image formed on the photosensitive drum 1 with the developer.

Furthermore, as illustrated in FIG. 3B, the developing cartridges 204 each include a developer containing chamber (hereinafter, referred to as a toner containing chamber) 218*a* and a developer chamber 218*b* in which the development roller 217 is disposed. The developing chamber 218*b* includes a toner feed roller 220 serving as a developer feed member that is in contact with the development roller 217 and that rotates in an arrow E-direction, and a development blade 21 serving as a developer regulating member that regulates the toner layer on the development roller 217. Both end portions of the toner feed roller 220 are rotatably supported by the developer frame 218. A coupling member 4028 is fixed to an end portion of a metal core (a shaft) of the toner feed roller 220 and rotates together with the toner feed roller 220 in an integrated manner. The development blade 21 is fixed to a fixation member 22 by welding or the like in an integral manner. Furthermore, the toner containing chamber 218*a* of the developer frame 218 is provided with a mixing member 23 that mixes the toner accommodated inside the toner containing chamber 218*a* and that conveys the toner to the toner feed roller 220.

Driving of Each Development Roller

As illustrated in FIG. 4, when the coupling member (a driving force receiving member) 4028 rotates, transmission of the driving force from the coupling member 4028 to a shaft of the toner feed roller 220 rotates the toner feed roller 220. With the rotation of the toner feed roller 220, a toner feed roller gear 298 fixed to an end portion of the shaft of the toner feed roller 220 on a Z1 direction side rotates. With the above, the driving force is transmitted to a development roller gear 299 that is fixed to an end portion of a shaft of the development roller 217 on the Z1 direction side and that meshes with the toner feed roller gear 298, and the development roller 217 is rotated.

Configuration of Each Developing Cartridge

FIG. 3A is an external perspective view of the developing cartridge 204. The developing cartridge 204 includes a developer frame 218 that supports various elements. The developing cartridge 204 is provided with the development roller 217 serving as the developer carrying member that is in contact with the photosensitive drum 3 and that rotates. The development roller 217 is rotatably supported at both end portions thereof in the longitudinal direction by the developer frame 218 with developer bearings 219 (219R and 219L) interposed therebetween. Note that the developer bearings 219 (219R and 219L) are attached to two side portions of the developer frame 218.

Configuration of Main Body Drive Shaft

Figure 5:
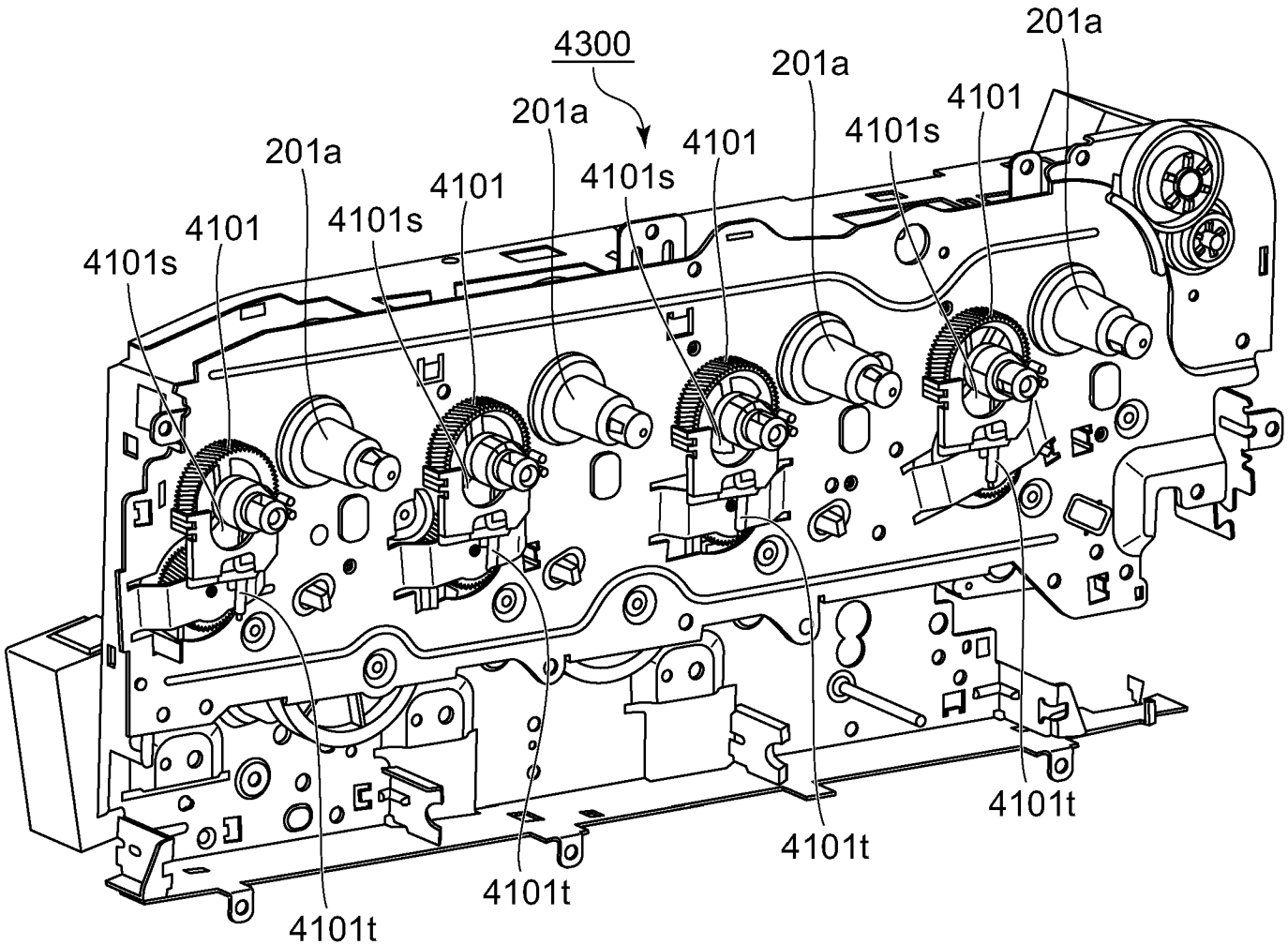
FIG. 5 is a perspective view of a drive unit.
Figure 6A:
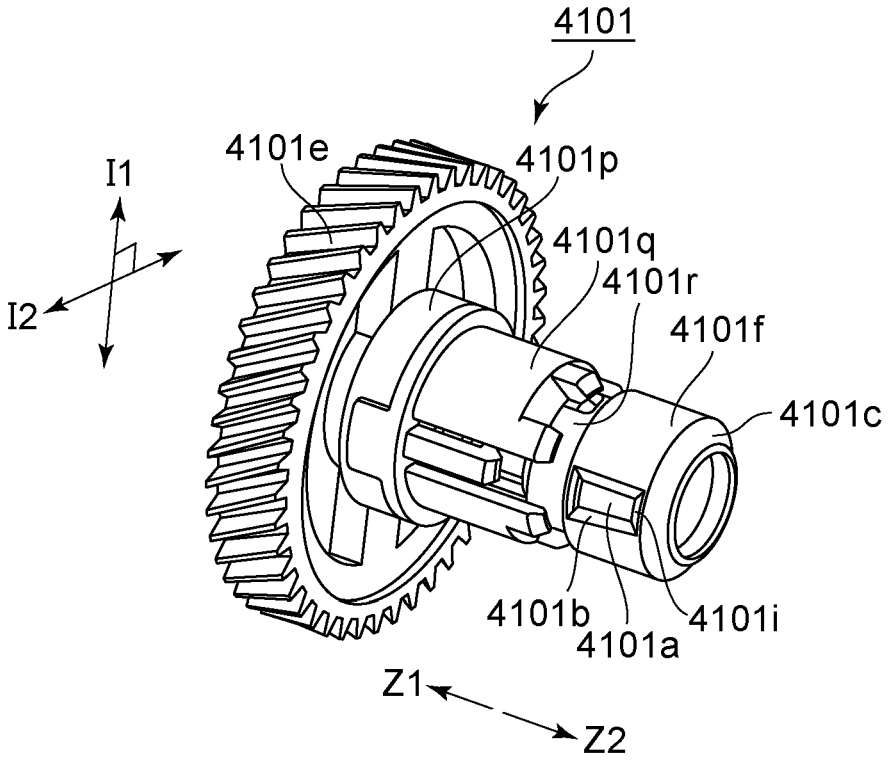
FIG. 6A is a perspective view of a main body drive shaft and FIG. 6B is an exploded perspective view of the main body drive shaft.
Figure 6B:
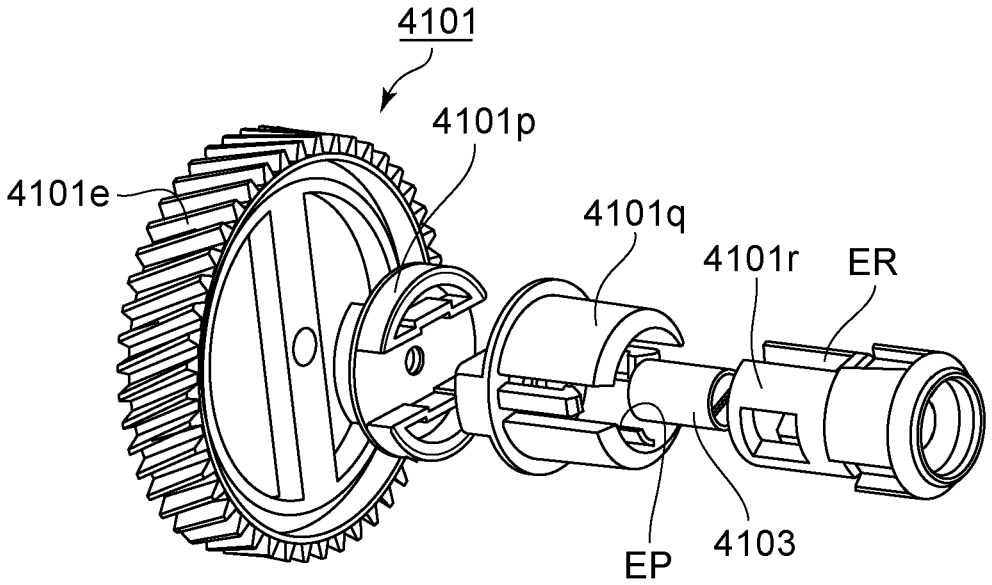
Figure 7:
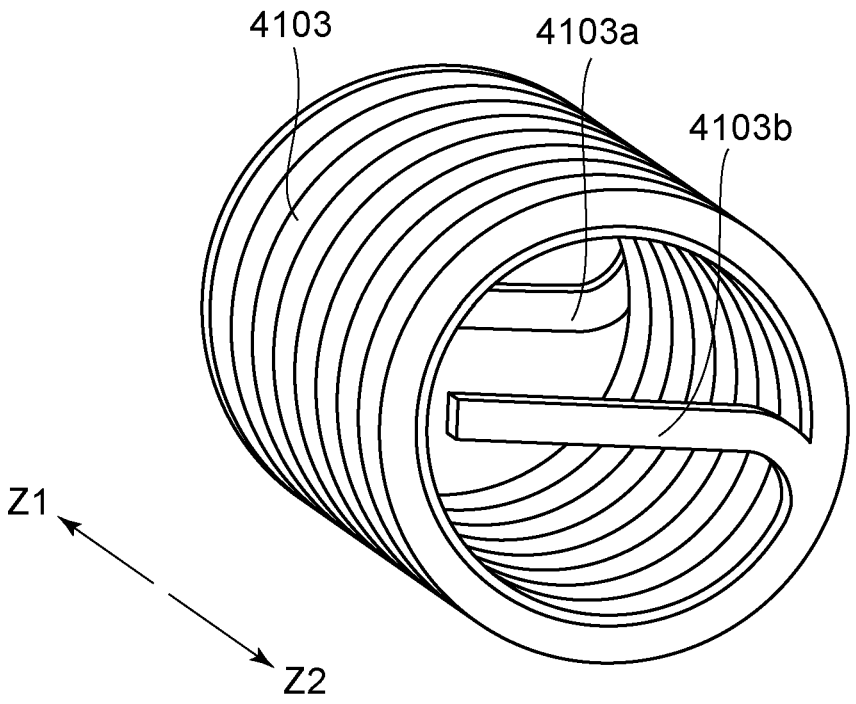
FIG. 7 is a perspective view of a spring member.

Referring to FIGS. 5 to 9, a configuration of a main body drive shaft 4101 will be described. FIG. 5 is a perspective view of a drive unit 4300 included in an image forming apparatus main body 1A. FIG. 6A is a perspective view of one of the main body drive shafts 4101 in the drive unit 4300. FIG. 6B is an exploded perspective view of the main body drive shaft 4101. FIG. 7 is a perspective view of a spring member 4103. As illustrated in FIG. 5, the drive unit 4300 is attached to the image forming apparatus main body from the rear side.

As illustrated in FIG. 5, the drive unit 4300 includes the main body drive shafts 4101 that engage with the coupling members 4028 of the developing cartridges 204 and that transmit driving force thereto. Furthermore, the drive unit 4300 includes main body drive shafts 201*a* that engage with the coupling members 228*a* of the drum cartridges 213 and that transmits driving force thereto.

As illustrated in FIGS. 6A and 6B, each main body drive shaft 4101 includes a gear member 4101*e*, an intermediate member 4101*p*, an output member 4101*q*, and a drive transmitting members 4101*r*. The image forming apparatus main body 1A is provided with a motor (not shown) serving as a drive source. The gear member 4101*e* receives rotational drive from the motor. The drive is transmitted in the order of the intermediate member 4101*p*, the output member 4101*q*, and the drive transmitting member 4101*r* so that the main body drive shaft 4101 is rotated. Furthermore, the gear member 4101*e*, the intermediate member 4101*p*, and the output members 4101*q* have an Oldham coupling mechanism that allows movement of a predetermined distance in an I1 direction and in an I2 direction that are orthogonal to the rotational axis of the main body drive shaft 4101 and that is orthogonal to each other. Accordingly, the drive transmitting member 4101*r* that is provided on the cartridge side of the main body drive shaft 4101 with the Oldham coupling in between can also be moved a predetermined distance in the X direction and the Y direction. Furthermore, the drive transmitting member 4101*r* is provided with a rotatable shaft portion 4101*f*, and the rotational driving force from the motor is transmitted to the developing cartridge 204 through groove-shaped drive transmission grooves (groove portions) 4101*a* provided in the shaft portion 4101*f*. Furthermore, the shaft portion 4101*f* includes a conical shape 4101*c* at a distal end thereof. Each main body drive transmission grooves 4101*a* has a shape allowing a portion of an engaging portion 4073 described later to enter therein. Specifically, the shaft portion 4101*f* includes main body drive transmission surfaces 4101*b* serving as surfaces that transmit driving force by coming in contact with driving force receiving surfaces 4073*a* of the coupling member 4028. Note that each main body drive shaft 201*a* also includes groove-shaped drive transmission grooves that transmit rotational driving force from a motor (not shown) to the corresponding drum cartridge 213.

Furthermore, as illustrated in FIG. 6A, the main body drive transmission surface 4101*b* does not have a flat surface but has a twisted shape twisted about the axis of rotation of the main body drive shaft 4101. The direction of the twist is a direction in which a portion of the main body drive shaft 4101 on a Z1 direction side becomes disposed on the upstream side in the rotation direction of the main body drive shaft 4101 with respect to a portion of the main body drive shaft 4101 on the Z2 direction side. In the present exemplary embodiment, a twisted amount of each of the engaging portions 4073 twisted along the rotational axis direction of the cylinder of the corresponding engaging portion 4073 is about 1° per 1 mm. The reason for having the main body drive transmission surface have a twisted shape will be described later.

Furthermore, a main body-side evulsion taper 4101*i* is provided in a surface of each main body drive transmission groove 4101*a* on the Z2 direction side. The main body-side evulsion taper 4101*i* is a taper (an inclined surface or an inclined portion) that facilitates the engaging portion 4073 to break away from the drive transmission groove 4101*a* when the developing cartridge 204 is taken out from the apparatus main body 1A.

Figure 8A:
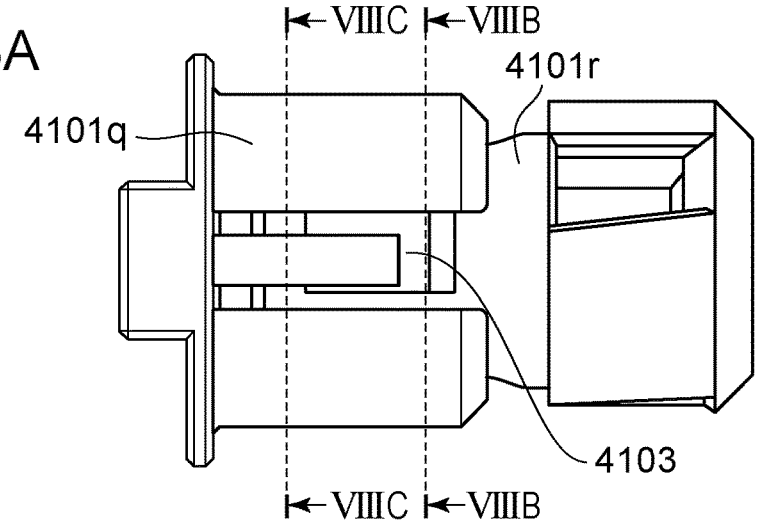
FIG. 8A is a side view of an output member to which a drive transmitting member has been attached.
Figure 8B:
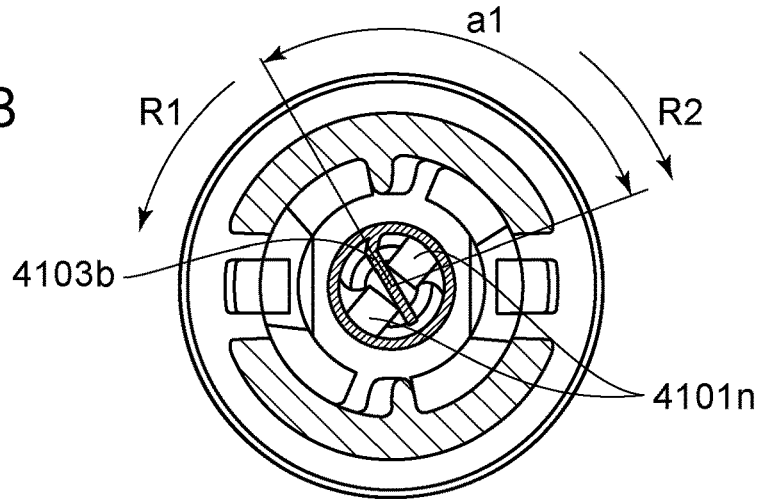
FIG. 8B is a cross-sectional view taken along line VIIIB-VIIIB in FIG. 8A.
Figure 8C:
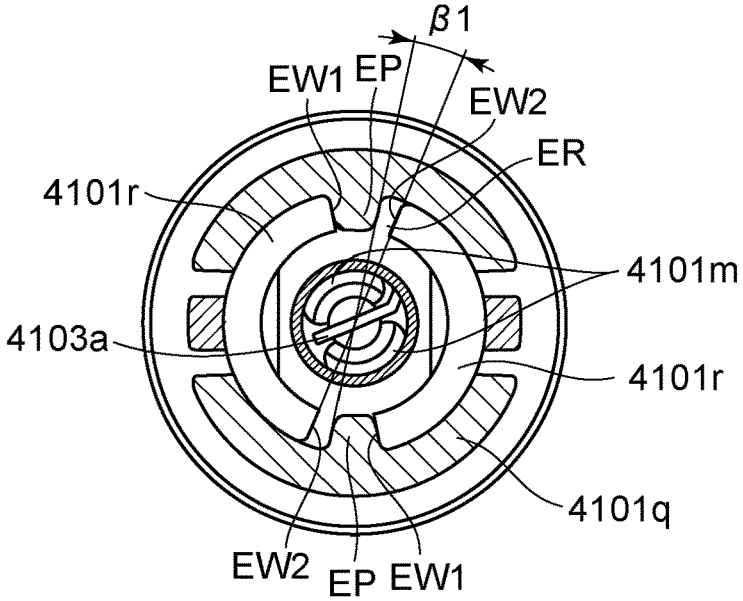
FIG. 8C is a cross-sectional view taken along line VIIIC-VIIIC in FIG. 8A.

Furthermore, as illustrated in FIG. 6B, each spring member 4103 that is an elastic member is attached between the corresponding output member 4101*q* and the corresponding drive transmitting member 4101*r*. FIG. 7 illustrates an outline drawing of the spring member 4103. Furthermore FIG. 6 is a drawing illustrating a method of installing the drive transmitting member 4101*r* to the output member 4101*q*. The spring member 4103 is a compression spring and biases the drive transmitting member in a Z2 direction. Furthermore, arm portions 4103*a* and 4103*b* are provided at the two ends of the spring member 4103. FIG. 8A is a side view of the output member 4101*q* to which the drive transmitting member 4101*r* has been attached. FIG. 8B is a cross-sectional view taken along line VIIIB-VIIIB in FIG. 8A, and FIG. 8C is a cross-sectional view taken along line VIIIC-VIIIC in FIG. 8A. The arm portion 4103*a* engages with an output member fixed portion 4101*m* of the output member 4101*q* to restricts the rotation relative to the output member 4101*q*. Furthermore, the arm portion 4103*b* engages with a transmitting member fixed portion 4101*n* of the drive transmitting member 4101*r*, and restricts the rotation relative to the drive transmitting member 4101*r*.

As illustrated in FIGS. 6B and 8C, protrusions EP are provided on the output member 4101*q*, and recesses ER formed by wall surfaces EW1 and EW2 are provide in the drive transmitting member 4101R. When the drive transmitting member 4101*r* is attached to the output member 4101*q*, the drive transmitting member 4101*r* is, relative to the output member 4101*q*, twisted in an R1 direction by an angle α1° from a state in which the phases of the arm portions 4103*a* and 4103*b* of the spring member 4103 coincide. With the above, the drive transmitting member 4101*r* is, with respect to the drive transmitting member 4101*r*, at a phase that allows the protrusions EP to enter the recesses ER. The drive transmitting member 4101*r* holds the output member 4101*q* while maintaining the above phase. In the above state, the protrusions EP can, within the width of the recesses ER, rotate at an angle β1 about the rotational axis of the main body drive shaft 4101. Accordingly, the drive transmitting member 4101*r* can, relative to the output member 4101*q*, rotate at an angle β1 about the rotational axis of the main body drive shaft 4101. In other words, play (angle β1) in the rotation direction of the drive transmitting member 4101*r* is provided between the drive transmitting member 4101*r* and the output member 4101*q*. Furthermore, due to restoring force (biasing force) of the spring member 4103 in the rotation direction about the rotational axis of the main body drive shaft 4101, the drive transmitting member 4101*r* receives biasing force in an R2 direction at all times. In other words, owing to the biasing force of the spring member 4103, the wall surfaces (stopping portion) EW1 of the drive transmitting member 4101*r* that forms the recesses ER is abutted in the R2 direction against the protrusions EP of the output member 4101*q*. Note that details of the movement will be described later.

Figure 9:
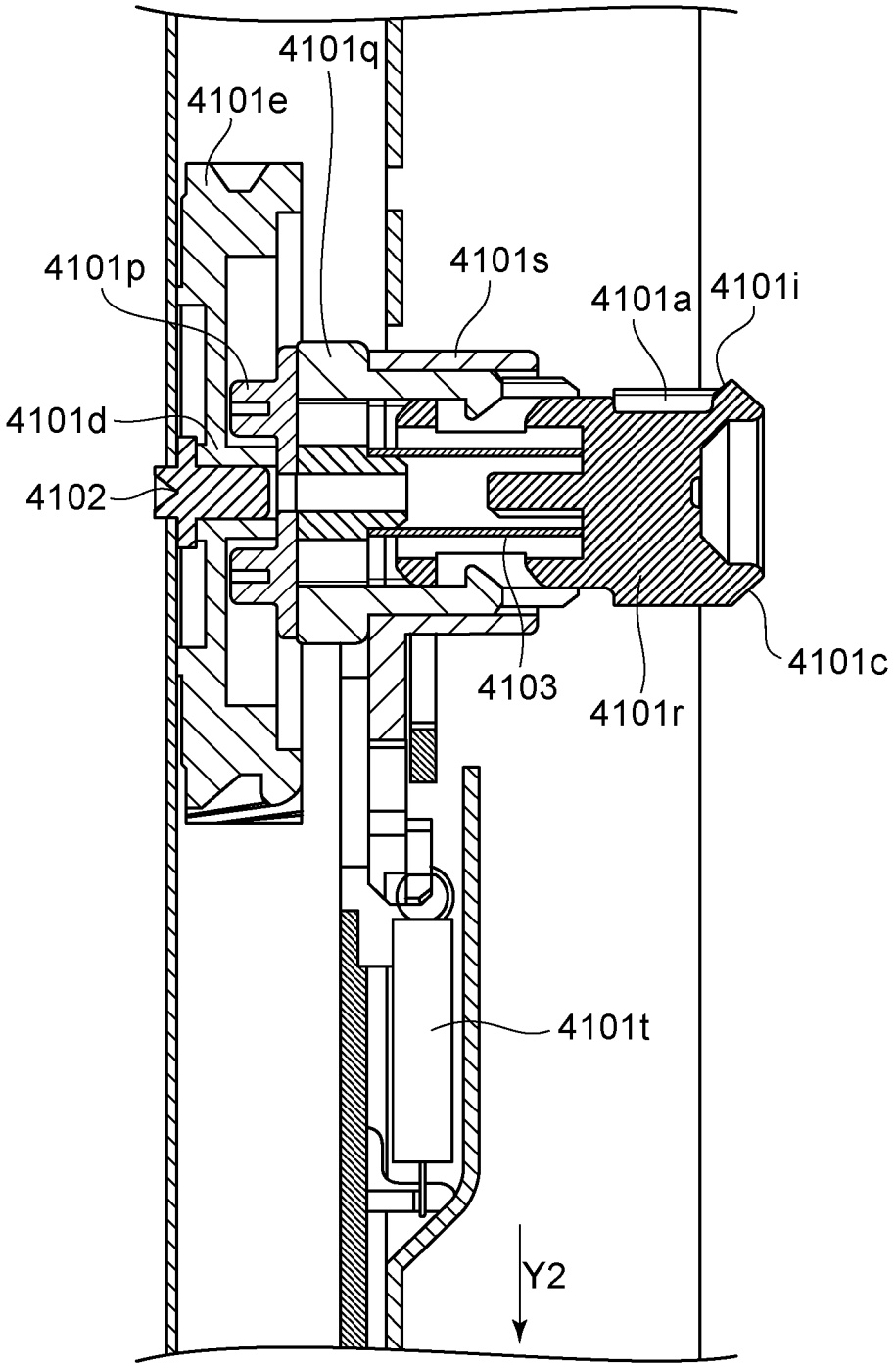
FIG. 9 is a cross-sectional view of a vicinity of a main body drive shaft of an apparatus main body including a section along a rotational axis of the main body drive shaft.

FIG. 9 is a cross-sectional view of the vicinity of the main body drive shaft 4101 of the apparatus main body 1A including a section along the rotational axis of the main body drive shaft 4101. As illustrated in FIG. 9, a bearing 4101*d* provided in the gear member 4101*e* is rotatably supported by a bearing member 4102 provided in the image forming apparatus main body 1A. The output member 4101*q* is rotatably supported by a coupling holder 4101*s*. Furthermore, the drive transmitting member 4101*r* is supported by the output member 4101*q* so as to be movable in the Z direction, and is biased towards the developing cartridges 204 side (in the Z2 direction) with the spring member 4103. However, a movable amount (a gap) of the drive transmitting member 4101*r* in the Z direction is about 1 mm, and is sufficiently smaller than a width of the driving force receiving surface 4073*a* described later in the Z direction.

Moreover, the coupling holder 4101*s* is biased in substantially a Y2 direction with a biasing spring 4101*t*. Accordingly, as described later, when mounting the developing cartridge 204, the drive transmitting member 4101*r* is at a position shifted in the substantially Y2 direction with respect to the axial line of the gear member 4101*e*.

As described above, the main body drive transmission grooves 4101*a* are provided in the drive transmitting members 4101*r*, and the engaging portions 4073 are provided in the coupling members 4028 so that drive is transmitted from the apparatus main body to the developing cartridges 204.

While the details will be described later, note that the engaging portions 4073 are provided at distal ends of base portions 4074 that can be elastically deformed. Accordingly, when the developing cartridges 204 are mounted in the apparatus main body 1A, the engaging portions 4073 can be moved towards an outer side in the radial direction. With the above, as the developing cartridges 204 are inserted into the apparatus main body 1A, the engaging portions 4073 enter the drive transmission grooves 4101*a*; accordingly, the engaging portions 4073 and the drive transmission grooves 4101*a* can be engaged with each other.

Configuration of Each Coupling Member

Figure 10B:
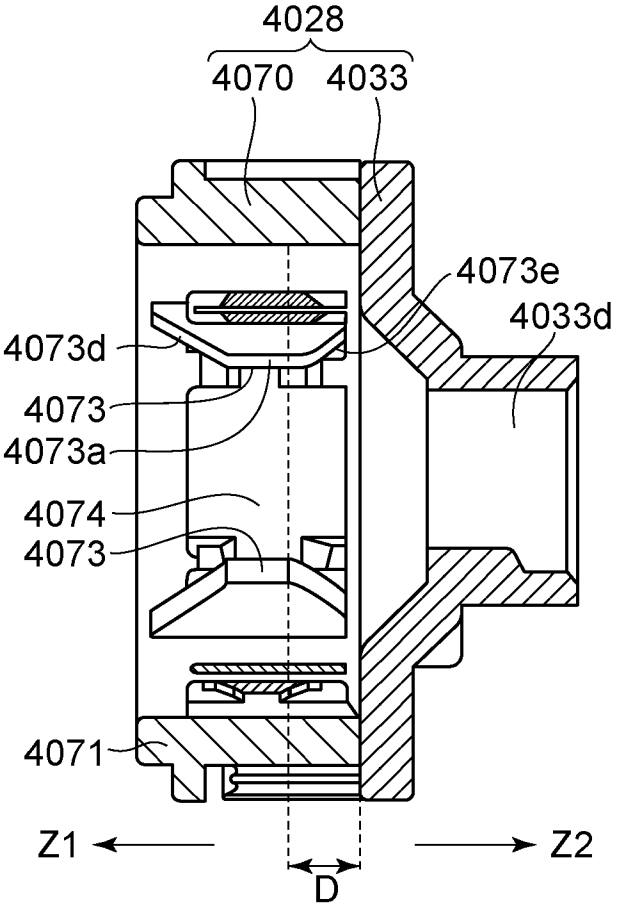
FIG. 10A is a coupling member viewed in a rotational axis direction thereof and FIG. 10B is a cross-sectional view taken along line XB-XB.
Figure 10A:
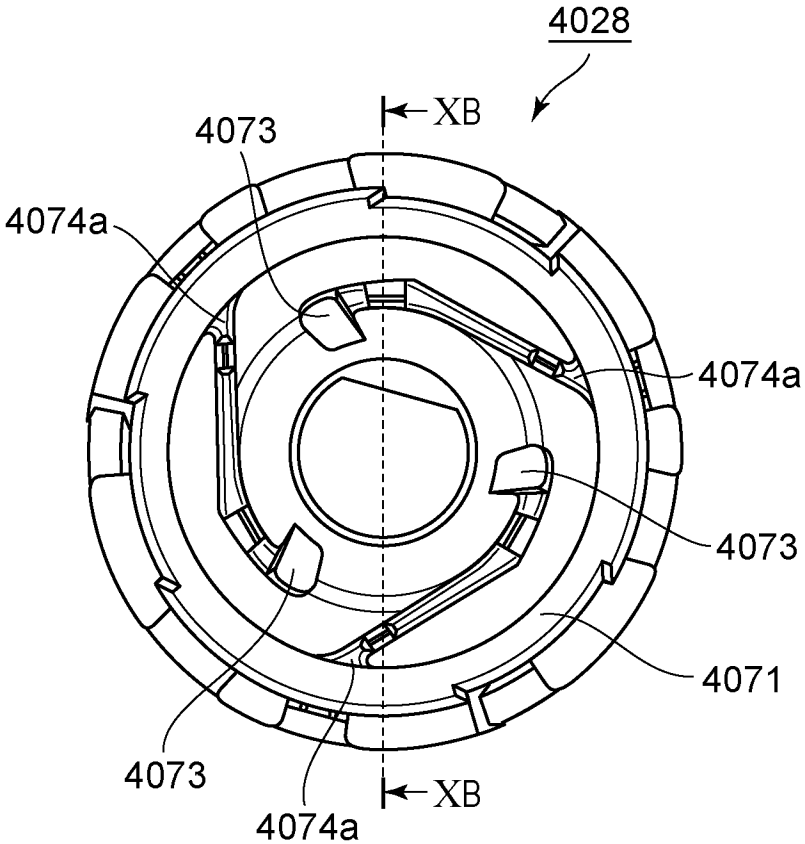
Figure 11:
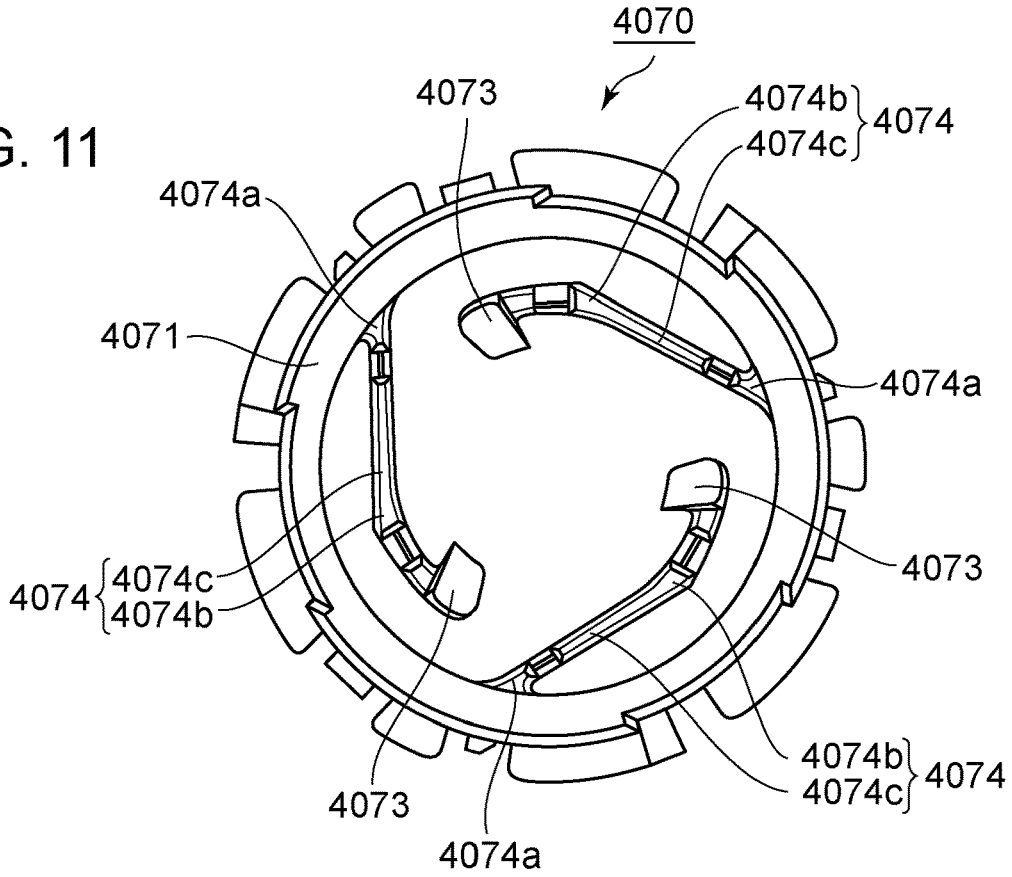
FIG. 11 is a cylinder member viewed in a rotational axis direction thereof.
Figure 12:
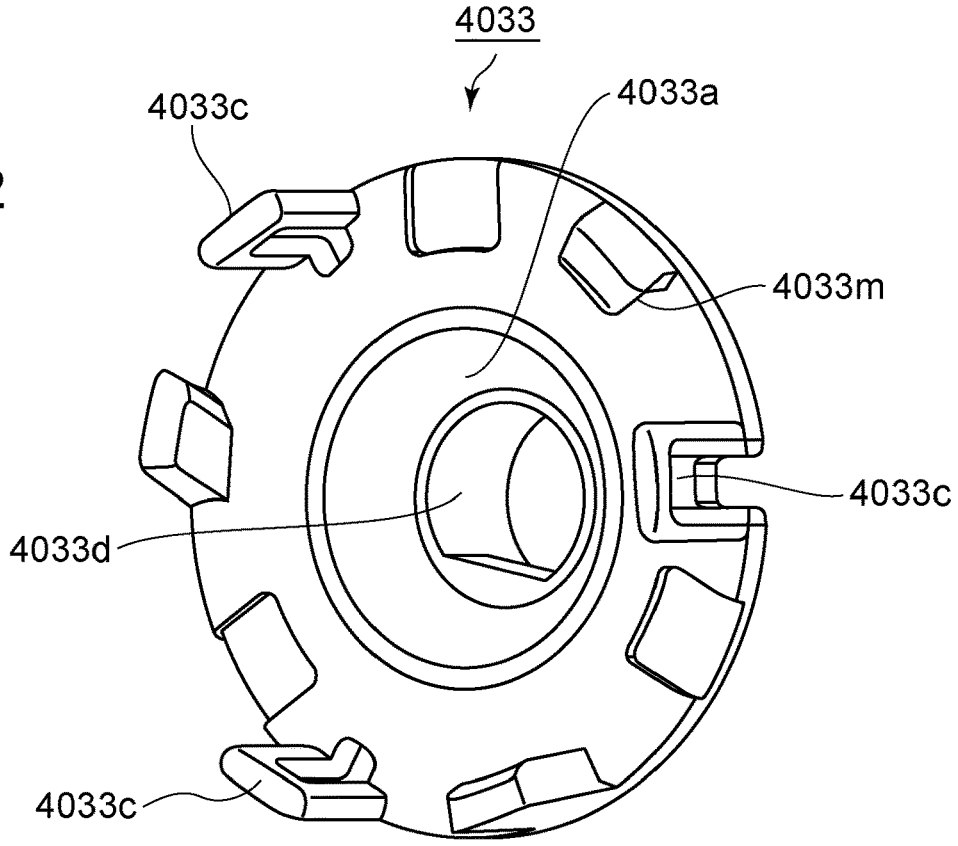
FIG. 12 is a perspective view of an aligning member.
Figure 13:
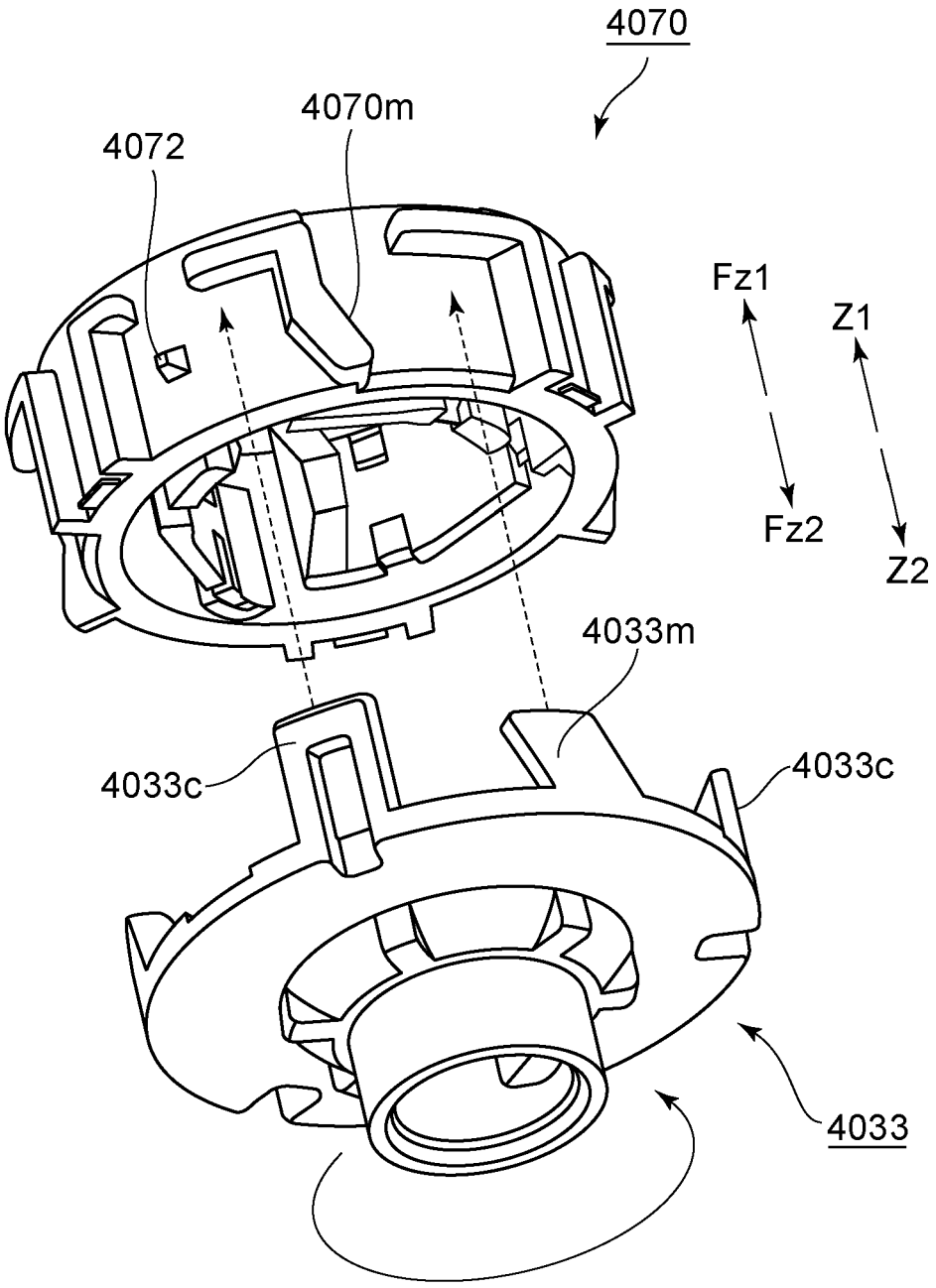
FIG. 13 is a perspective view illustrating assembling of the coupling member.

Referring next to FIGS. 10A to 13, the coupling member 4028 will be described in detail. FIG. 10A is a diagram of the coupling member 4028 viewed in the rotational axis direction (the outside in the Z direction) thereof, and FIG. 10B is a cross-sectional view taken along line XB-XB in FIG. 10A. FIG. 11 is a diagram of a cylinder member 4070 viewed in the rotational axis direction (the outside in the Z direction) thereof. FIG. 12 is a perspective view of an aligning member 4033. FIG. 13 is a diagram illustrating assembling of the coupling member 4028.

As illustrated in FIGS. 10A and 10B, the coupling member 4028 in the present exemplary embodiment is a combination of two members, namely the cylinder member 4070 and the aligning member 4033. Depending on the material and the forming method, the coupling member 4028 does not have to be formed of two members but may be a single member, or may be a combination of three or more members. The aligning member 4033 is a positioning member that sets the position of the coupling member 4028 with respect to the drive transmitting shaft, and is a transmitted member to which driving force from the cylinder member 4070 is transmitted.

As illustrated in FIG. 13, the aligning member 4033 is installed in the cylinder member 4070 in the axial direction of the cylinder member 4070. Furthermore, by turning the aligning member 4033 in the anticlockwise direction, a stopper portion engages with a hooking portion and the aligning member 4033 and the cylinder member 4070 become a unit.

Flange Member

As illustrated in FIG. 11, the base portions 4074 of the cylinder member 4070 each includes a base portion 4074*a*, a winding portion 4074*b*, and a straight portion 4074*c* that connects the base portion 4074*a* and the winding portion 4074*b* to each other in a linear manner.

The engaging portions 4073 provided in the cylinder member 4070 engage with the main body drive shaft 4101; accordingly, the engaging portions 4073 protrude inside at least the coupling member 4028 in the radial direction. The engaging portions 4073 are provided at the distal ends of the base portions 4074, and include the driving force receiving surfaces 4073*a*. The driving force receiving surfaces 4073*a* are driving force receiving portions that receive driving force from the main body drive shaft 4101 by contacting the drive transmission grooves 4101*a*. Furthermore, the engaging portions 4073 are equidistantly disposed at three portions in a circumferential direction of the coupling member 4028. In a similar manner, the base portions 4074 are also equidistantly disposed at three portions in a circumferential direction of a cylindrical portion 4071. The base portion 4074 includes a fixing end in the cylindrical portion 4071, and has a shape allowing elastic deformation from the fixing end. In other words, the base portions 4074 are extending portions that extend in at least the circumferential direction of the coupling member 4028. Furthermore, the engaging portions 4073 are protrusions provided at the distal ends of base portions 4074. The base portions 4074 and the engaging portions 4073 are support portions that support the driving force receiving surfaces 4073*a*.

The engaging portions 4073 are supported by the elastically deformable base portions 4074 and, with the deformation of the base portions 4074, can move in the radial direction about the rotational axis of the coupling member 4028. In other words, the base portions 4074 become deformed when external force is applied thereto, and have restoring force that returns the base portions 4074 to the natural positions of the base portions 4074. Furthermore, in a state in which the developing cartridges 204 are mounted in the apparatus main body 1A and the positions thereof are set, each engaging portion 4073 can be moved in the radial direction about the rotational axis of the corresponding drive transmitting member 4101*r* that is practically coaxial to the rotational axis of the corresponding coupling member 4028. Each engaging portion 4073 can move between an engageable position and a non-engagement position by moving in the radial direction about the rotational axis of the corresponding drive transmitting member 4101*r*.

Specifically, when the engaging portions 4073 come in contact with an outer peripheral surface of the drive transmitting member 4101*r*, the engaging portions 4073 become elastically deformed and move towards the outside (towards the non-engagement position) in the radial direction along the outer peripheral surface of the drive transmitting member 4101*r*. Subsequently, when the engaging portions 4073 are at the same positions (the same phases) as those of the main body-side drive transmission grooves 4101*a* provided in the outer peripheral surface of the drive transmitting member 4101*r*, the elastic deformation of each engaging portion 4073 is eliminated. With the above, the engaging portions 4073 moves inwards (towards the engageable position) in the radial direction so that portions of the engaging portions 4073 can enter the main body drive transmission grooves 4101*a*. It is desirable that a plurality of engaging portions 4073 are disposed in a circumferential direction of the cylinder member 4070 for the sake of driving stability.

Furthermore, the driving force receiving surfaces 4073*a* of each coupling member 4028 each have a twisted shape twisted about the axial line of the coupling member 4028, and in the present exemplary embodiment, the twisted amount is the same as that of the main body drive transmission surface 4101*b*. Note that in the drive force receiving surfaces 4073*a*, it is only sufficient that the phases of the two points in contact with the drive transmitting member 4101*r* in the rotation direction are different. In other words, the driving force receiving surfaces 4073*a* do not necessarily have to have a twisted shape as long as the driving force receiving surfaces 4073*a* have a function that is equivalent to that of the twisted surfaces. By forming each driving force receiving surface 4073*a* in a twisted shape or in an inclined shape, when the driving force receiving surface 4073*a* receives a drive, a force that draws the coupling member 4028 to the outside (the Z1 direction side) of the developing cartridges 204 is exerted.

Moreover, as illustrated in FIG. 10B, the engaging portions 4073 include insertion tapered surfaces 4073*d* on the outside (on the Z1 direction side) of the developing cartridge 204 in the Z direction serving as force receiving portions during mounting. Furthermore, the engaging portions 4073 include evulsion tapered surfaces 4073*e* on the inside (on the Z2 direction side) of the developing cartridges 204 in the Z direction serving as force receiving portions during dismounting. With the above, the performance of mounting and dismounting the coupling members 4028 in and from the main body drive shaft 4101 can be improved.

During mounting, the insertion tapered surfaces 4073*d* and the conical shape 4101*c* abut against each other and the engaging portions 4073 are moved towards the outer side of the drive shaft in the radial direction. Furthermore, when drawing out, the evulsion tapered surfaces 4073*e* and the main body-side evulsion taper abut against each other and the engaging portions 4073 moves towards the outer side of the main body drive shaft 4101 in the radial direction.

As illustrated in FIG. 12, the aligning member 4033 includes a positioning portion 4033*a*. The positioning portion 4033*a* is a portion that determines the positions of the main body drive shaft 4101 of the drive transmitting member 4101*r* in the axial direction and in the radial direction. The positioning portion 4033*a* has a curved surface forming an inverted conical shape. By having the curved surface come in contact with the conical shape 4101*c* of the drive transmitting member 4101*r*, the drive transmitting member 4101*r* is restricted from moving in the axial direction and the radial direction of the main body drive shaft 4101.

Driving of Coupling Member with Main Body Drive Shaft

As described above, the driving force receiving surfaces 4073*a* each have a twisted shape twisted about the axis of rotation of the cylinder member 4070. The above is to have the inverted conical shape 4033*a* of the aligning member 4033 to reliably abut against the conical shape 4101*c* at the distal end of the main body drive shaft 4101 when the driving force receiving surfaces 4073*a* receive drive from the main body drive shaft 4101.

By having the inverted conical shape 4033*a* of the aligning member 4033 abut against the conical shape 4101*c* at the distal end of the main body drive shaft 4101, the axial line of the drive transmitting member 4101*r* is prevented from inclining against the axial line of the cylinder member 4070. The deviation between the axes of the cylinder member 4070 and the drive transmitting member 4101*r* can be absorbed with the Oldham coupling mechanism described above provided in the apparatus main body so that the effect on the rotation can be suppressed to a small degree.

Furthermore, when the winding portion 4074*b* receives driving force from the main body drive shaft 4101, the winding portion 4074*b* winds around the shaft portion 4101*f*. With the above, even when the load received by the cylinder member 4070 changes, the deformation amount of the base portion 4074 is small; accordingly, the effect the deformation has on the rotation of the cylinder member 4070 can be suppressed to a small amount.

The drive from the cylinder member 4070 to the aligning member 4033 is transmitted by, as illustrated in FIG. 13, engaging flange drive transmission surfaces (transmission portions) 4070*m* and aligning drive transmission surfaces 4033*m* to each other. Three flange drive transmission surfaces 4070*m* and three aligning drive transmission surfaces 4033*m* are equidistantly disposed in the circumferential direction of the cylinder member 4070 and the aligning member 4033. Furthermore, the flange drive transmission surfaces 4070*m* and the aligning drive transmission surfaces 4033*m* each have a twisted shape twisted along the axial lines of the cylinder member 4070 and the aligning member 4033, and the twisted amount is about 2° per 1 mm. Owing to the driving force receiving surfaces 4073*a*, the cylinder member 4070 receives force Fz1 that draws the cylinder member 4070 to the outside (the Z1 direction side) of the developing cartridge 204. Furthermore, owing to the flange drive transmission surfaces 4070*m*, the cylinder member 4070 receives force Fz2 that draws the cylinder member 4070 to the inside (the Z2 direction side) of the developing cartridge 204. The twisted amount is set so that a relationship of Fz2>Fz1 is satisfied. Accordingly, the cylinder member 4070 is always drawn in the Z2 direction. Additionally, at least portions of engaging portions 4073D between the flange drive transmission surfaces 4070*m* and the aligning drive transmission surfaces 4033*m* in the Z direction are, in the Z direction, in a positional relationship overlapping the base portion 4074*a*; accordingly, deformation of the cylinder member 4070 can be suppressed.

Mounting of Cartridge in Image Forming Apparatus Main Body

Figure 14:
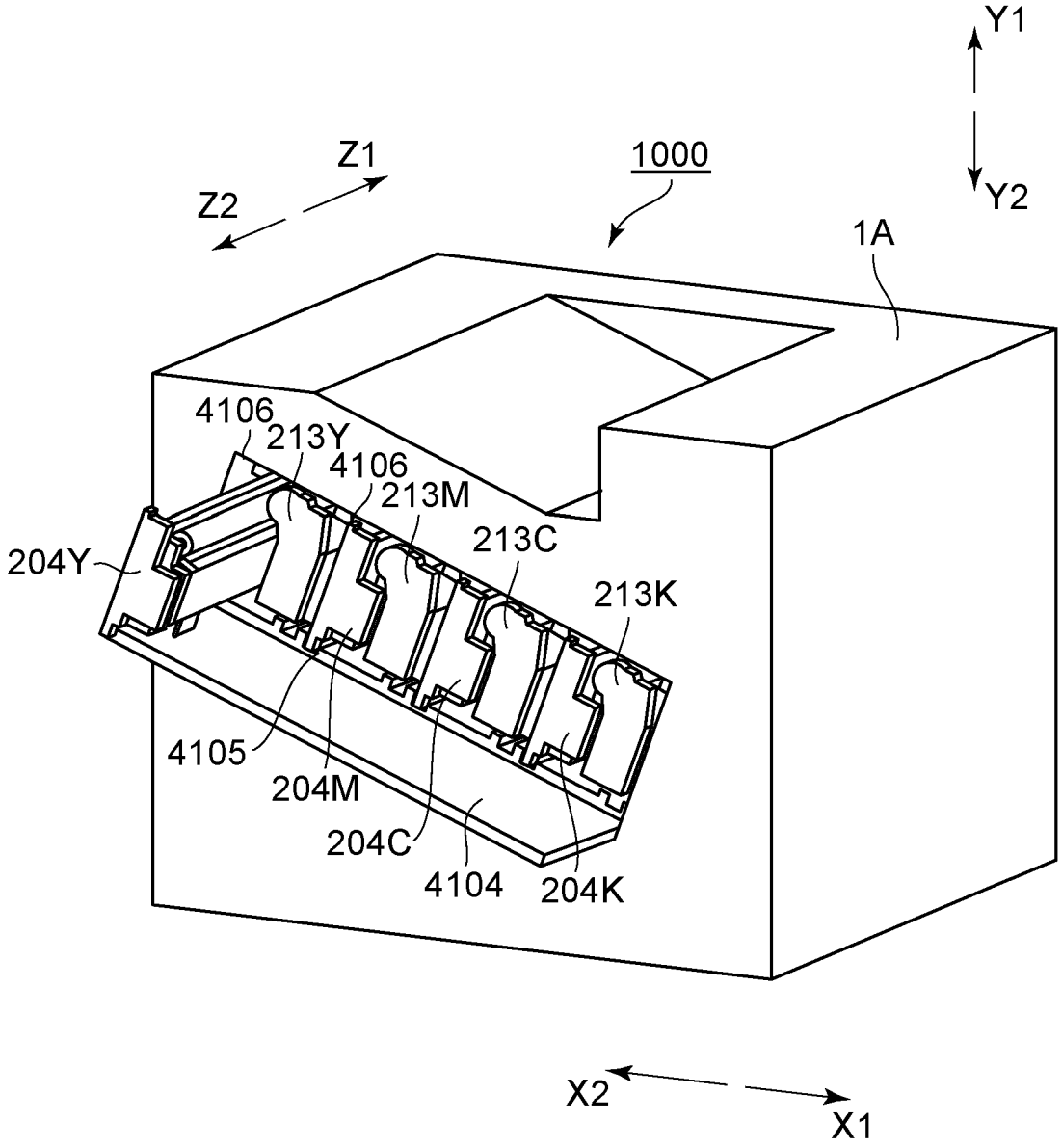
FIG. 14 is a perspective view illustrating mounting of the developing cartridges into an image forming apparatus main body.
Figure 15A:
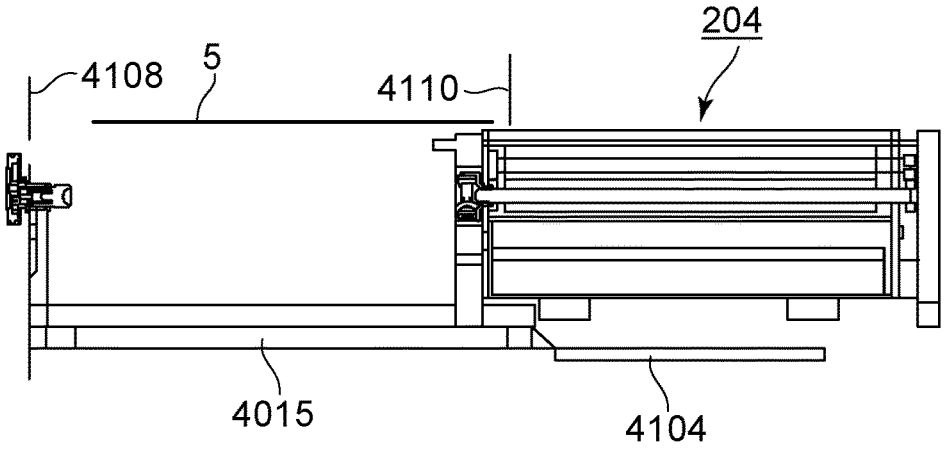
FIGS. 15A to 15C are cross-sectional views illustrating an operation of mounting the developing cartridge in an image forming apparatus main body.
Figure 15B:
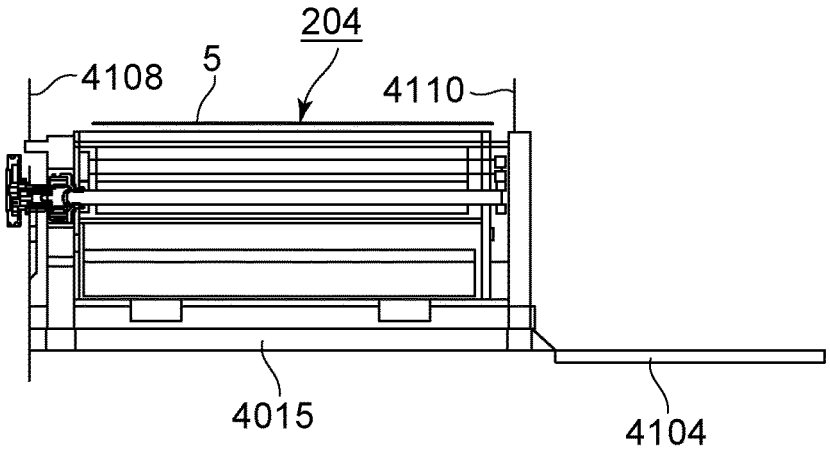
Figure 15C:
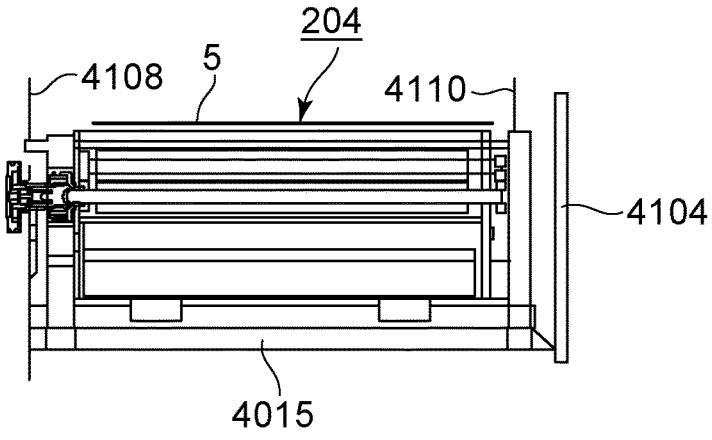

Referring to FIGS. 14 to 15C, mounting and dismounting of the developing cartridges 204 into and from the image forming apparatus main body 1A will be described. FIG. 14 is a perspective view illustrating mounting of the developing cartridges 204 into the image forming apparatus main body 1A. FIGS. 15A to 15C are cross-sectional views illustrating an operation of mounting the developing cartridge 204 into the image forming apparatus main body 1A.

The image forming apparatus of the present exemplary embodiment employs a configuration in which the developing cartridges 204 and the drum cartridges 213 can be mounted in the horizontal direction. Specifically, the image forming apparatus main body 1A is provided with a space allowing the developing cartridges 204 and the drum cartridges 213 to be mounted therein. Furthermore, the image forming apparatus main body 1A includes at the front side thereof a cartridge door 4104 used when the developing cartridges 204 and the drum cartridges 213 are inserted into the space described above.

As illustrated in FIG. 14, the cartridge door 4104 of the image forming apparatus main body 1A is provided in an openable and closeable manner. When the cartridge door 4104 is opened, disposed at a lower portion of the space are cartridge lower guide rails 4105 and at an upper portion of the space are cartridge upper guide rails 4106, which guide the developing cartridges 204. The developing cartridges 204 are guided to the mount positions with the upper and lower guide rails provided on the upper and lower portion of the space. The developing cartridges 204 are inserted to the mount positions along the axial lines of the development rollers 217.

Referring next to FIGS. 15A to 15C, a mounting and dismounting operation of the developing cartridges 204 with respect to the image forming apparatus main body 1A will be described. As illustrated in FIG. 15A, the developing cartridges 204 are inserted while the lower end portions of the developing cartridges 204 on the far side in the insertion direction are supported and guided by the cartridge lower guide rails 4105, and upper end portions on the far side in the insertion direction are guided by the cartridge upper guide rails 4106 (not shown). In so doing, the developer cartridges 204 are formed with sizes that do not come in contact with the intermediate transfer belt 5.

As illustrated in FIG. 15B, while the developing cartridges 204 are supported by the cartridge lower guide rails 4105, subsequently, the developing cartridges 204 are inserted in the horizontal direction and is inserted until abutting against a rear side cartridge positioning portions 4108 provided in the image forming apparatus main body 1A. Furthermore, when mounting the developing cartridges 204, as described above, the drive transmitting members 4101*r* of the image forming apparatus main body 1A are engaged with the coupling members 4028 while being biased in the substantially Y2 direction.

FIG. 15C is a diagram illustrating a state of the image forming apparatus main body 1A and the developing cartridges 204 when the cartridge door 4104 is in a closed state. The cartridge lower guide rails 4105 of the image forming apparatus main body 1A are configured to interlock with the cartridge door 4104 and move up and down with the opening and closing of the cartridge door 4104.

When the users close the cartridge door 4104, the cartridge lower guide rails 4105 move up. Subsequently, both end portions of the developing cartridges 204 abut against the cartridge positioning portions (4108 and 4110) of the image forming apparatus main body 1A so that the developing cartridges 204 are positioned with respect to the image forming apparatus main body 1A. Furthermore, the drive transmitting members 4101*r* of the image forming apparatus main body 1A following the developing cartridges 204 also move up.

The mounting of the developing cartridges 204 into the image forming apparatus main body 1A is completed with the above operation. Furthermore, the evulsion of the developing cartridges 204 from the image forming apparatus main body 1A proceeds in an order opposite to the order of the insertion operation described above.

Process of Engaging Coupling Members to Main Body Drive Shaft

Figure 16A:
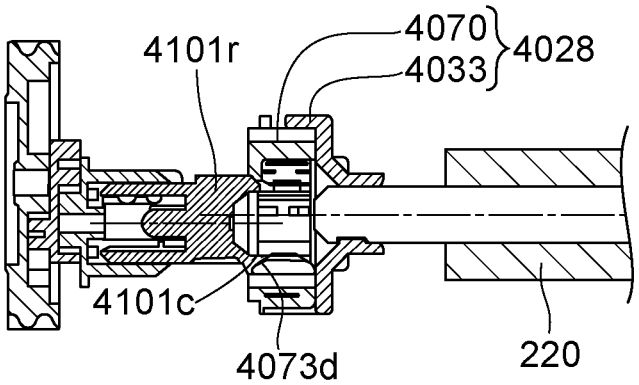
FIG. 16A is a cross-sectional view illustrating an operation of mounting the coupling member to the main body drive shaft.
Figure 16B:
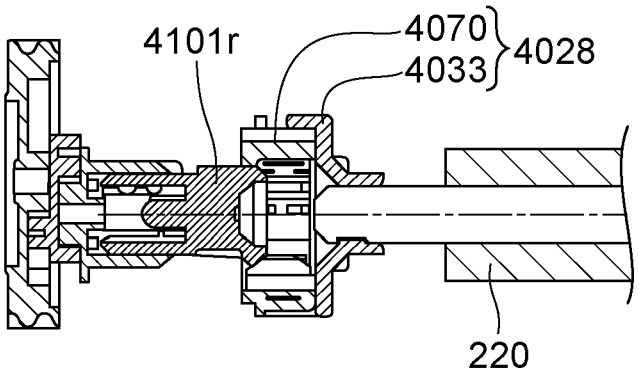
FIG. 16B is a cross-sectional view illustrating the operation of mounting the coupling member to the main body drive shaft.
Figure 16C:
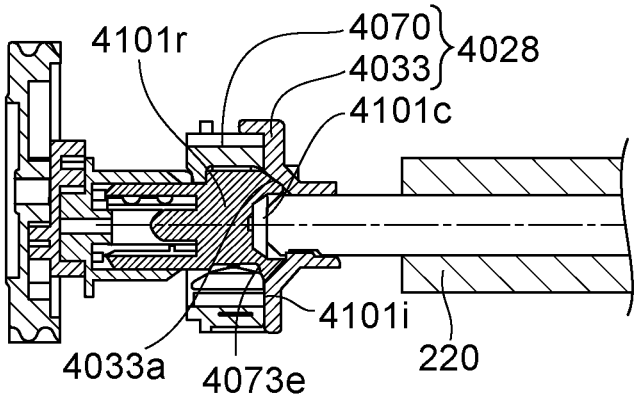
FIG. 16C is a cross-sectional view illustrating the operation of mounting the coupling member to the main body drive shaft.
Figure 16D:
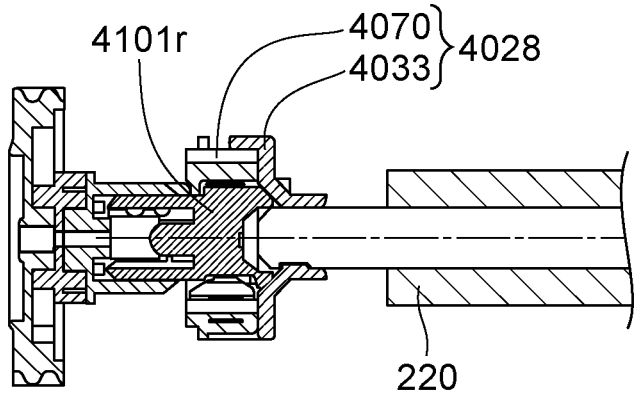
FIG. 16D is a cross-sectional view illustrating the operation of mounting the coupling member to the main body drive shaft.

Referring next to FIGS. 16A to 16D, a process of engaging the coupling members 4028 to the main body drive shaft 4101 will be described in detail. FIGS. 16A to 16D are cross-sectional views illustrating an operation of mounting the coupling members 4028 to the main body drive shaft 4101. FIG. 16A is a diagram illustrating a state in which the engaging of the coupling members 4028 to the drive transmitting members 4101*r* have started. Furthermore, FIG. 16D illustrates a state in which the developing cartridges 204 are mounted in the image forming apparatus main body 1A. In particular, the diagram illustrates a state in which the cartridge lower guide rails 4105 have moved up with the closing of the cartridge door 4104, and illustrates the developing cartridges 204 being positioned with respect to the image forming apparatus main body 1A.

Note that FIGS. 16B and 16C are, among the FIGS. 16A to 16D, diagrams that illustrate the mounting process of the coupling members 4028 and the drive transmitting members 4101*r*. Note that the drive transmitting members 4101*r* are biased in the substantially Y2 direction with the biasing springs 4101*t*, and the axial lines of the drive transmitting members 4101*r* are biased to positions shifted in the substantially Y2 direction with respect to the axial line of the coupling member 4028.

As described while referring to FIG. 14, in the state in which the developing cartridges 204 are supported by the cartridge lower guide rails 4105 of the image forming apparatus main body 1A, the developing cartridges 204 are installed in the horizontal direction. FIG. 16A illustrates a state in which the drive transmitting members 4101*r* and the coupling members 4028 do not abut against each other. As described above, in such a state, the axial lines of the drive transmitting members 4101*r* and the axial lines of the coupling members 4028 are deviated from each other. Accordingly, the insertion tapered surfaces 4073*d* of the coupling members 4028 first abut against the conical shape 4101*c* of the drive transmitting member 4101*r*.

As illustrated in FIG. 16B, from the state illustrated in FIG. 16A, the coupling members 4028 are inserted further towards the rear sides of the drive transmitting members 4101*r*. Then, the insertion tapered surfaces 4073*d* of the coupling members 4028 are guided by the conical shape 4101*c* of the drive transmitting member 4101*r*, and the rotational axes of the coupling members 4028 and the rotational axes of the drive transmitting members 4101*r* become substantially the same.

As illustrated in FIG. 16C, from the state illustrated in FIG. 16B, the coupling members 4028 are inserted further towards the rear sides of the drive transmitting members 4101*r*. Then, the coupling members 4028 are inserted over the drive transmitting members 4101*r* until the evulsion tapered surfaces 4073*e* of the engaging portions 4073 of the coupling members 4028 are at the rear side in the Z direction with respect to the main body-side evulsion tapers of the drive transmitting members 4101*r*. Subsequently, the coupling members 4028 are inserted over the drive transmitting members 4101*r* until the positioning portion 4033*a* of the coupling members 4028 and the conical shape 4101*c* of the drive transmitting member 4101*r* abut against each other.

Subsequently, as illustrated above, the developing cartridges 204 being lifted by the cartridge lower guide rails 4105 set the developing cartridges 204 into position with respect to the image forming apparatus main body 1A (FIG. 15C). Furthermore, with the lifting of the developing cartridges 204, the drive transmitting members 4101*r* are lifted as well.

Driving of Developing Cartridges

Figure 17A:
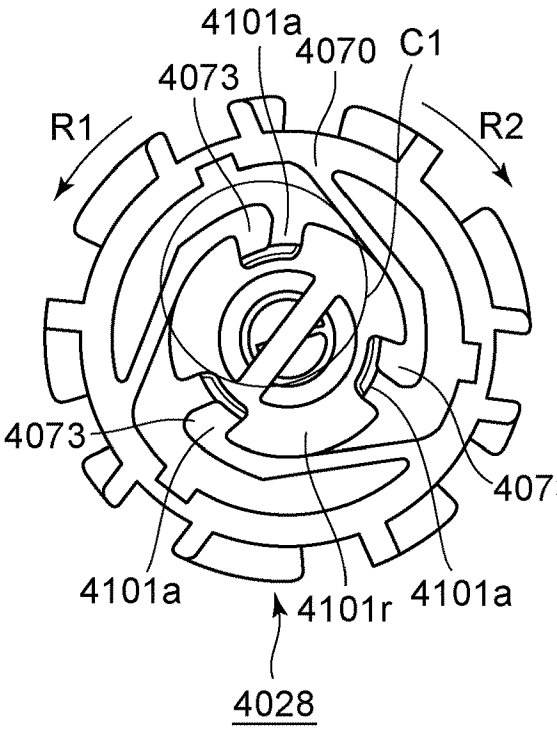
FIG. 17A is a diagram illustrating a state in which the coupling member is engaged with the main body drive shaft and in which a drive is transmitted.
Figure 17B:
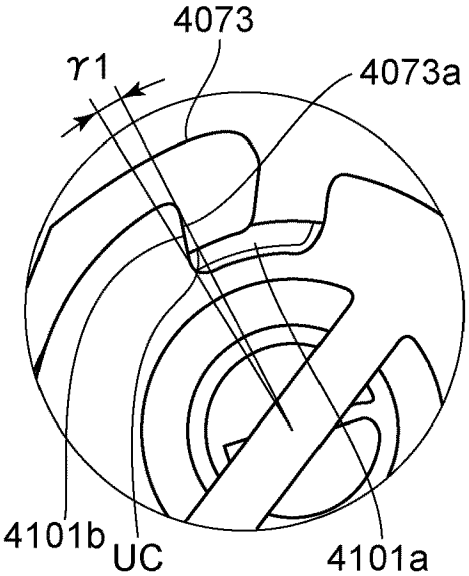
FIG. 17B is an enlarged view of a C1 portion in FIG. 17A.
Figure 17C:
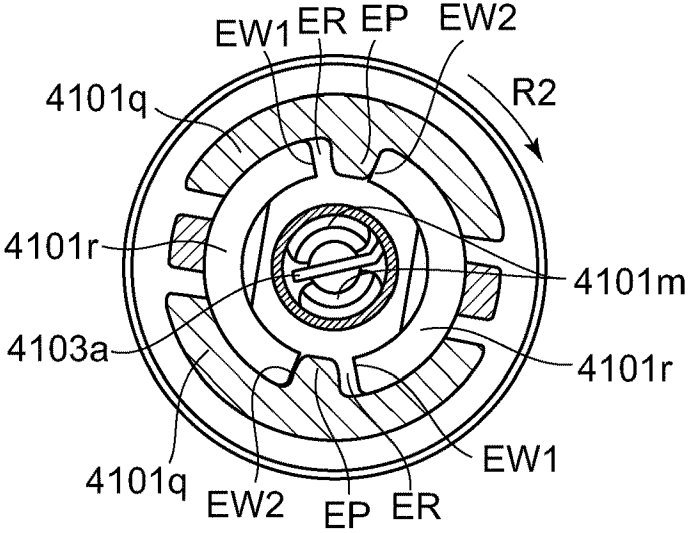
FIG. 17C is a cross-sectional view illustrating a relationship between the drive transmitting member and the output member while in a state in which the coupling member is engaged with the main body drive shaft and in which a drive is transmitted.
Figure 23:
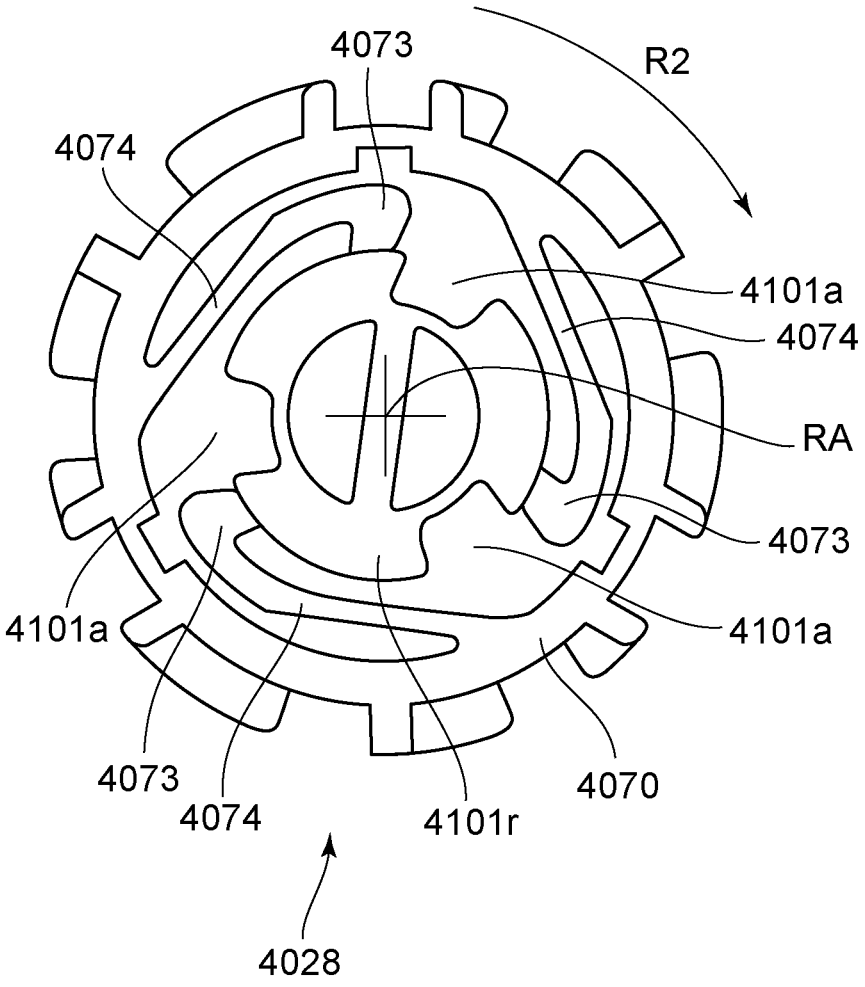
FIG. 23 is a diagram illustrating a relationship between the coupling member and the drive transmitting member.

Referring next to FIGS. 8A to 8C, 17A to 17C, and 23, driving of the developing cartridges 204 after the user has mounted the developing cartridges 204 in the apparatus main body 1A will be described. FIG. 17A is a diagram illustrating a state in which the coupling member 4028 is engaged with the main body drive shaft 4101 and is transmitting drive, and FIG. 17B is an enlarged view of a portion C1 in FIG. 17A. FIG. 17C is a cross-sectional view illustrating a relationship between the drive transmitting member 4101*r* and the output member 4101*q* while in a state in which the coupling member 4028 is engaged with the main body drive shaft 4101 and drive is transmitted, and the cross section is the same as the cross section taken along line VIIIC-VIIIC in FIG. 8A. FIGS. 17A, 17B, and 17C are all diagrams viewed in the rotational axis direction of the coupling member 4028. FIG. 23 is a diagram illustrating a relationship between the coupling member 4028 and the drive transmitting member 4101*r* viewed in the rotational axis direction of the drive transmitting member 4101*r*.

The drive of the main body drive shaft 4101 will be described first. When in a state in which the position of the developing cartridge 204 with respect to the image forming apparatus main body 1A is set and when in a stationary state before the driving, the drive transmitting member 4101*r* and the output member 4101*q* are in the state illustrated in FIG. 8C. In the above state, as illustrated in FIG. 23, the drive transmitting member 4101*r* and the coupling member 4028 are not in phase with each other and are not engaged with each other. When the motor (not shown) is driven in the above state, the output member 4101*q* is rotated in the R2 direction (a positive rotation direction) through the gear member 4101*e* and the intermediate member 4101*p*. The drive transmitting member 4101*r* receives driving force for rotating in the R2 direction from the output member 4101*q* through the spring member 4103. On the other hand, in the state illustrated in FIG. 23, since the three engaging portions 4073 are situated outside the drive transmission grooves 4101*a*, the base portions 4074 are elastically deformed in a direction (a radial direction) moving away from a rotational axis RA of the drive transmitting member 4101*r*. In the above situation, the three engaging portions 4073 are at non-engageable positions that do not allow engagement with the main body drive transmission surfaces 4101*b* in the radial direction about the rotational axis of the drive transmitting member 4101*r*. Accordingly, the drive transmitting member 4101*r* receives, from the three engaging portions 4073, the restoring force of the three base portions 4074 in the directions towards the rotational axis RA of the drive transmitting member 4101*r*. Accordingly, frictional force against a rotation of the drive transmitting member 4101*r* in the R2 direction is generated with the restoring force from the three engaging portions 4073. Furthermore, the development roller 217 of the developing cartridge 204 and the toner feed roller 220 are connected to the coupling member 4028, and the load to rotate the above members is larger than the restoring force of the spring member 4103. As a result, since the frictional force described above is larger than the biasing force of the spring member 4103, the drive transmitting member 4101*r* cannot rotate in the R2 direction.

Accordingly, even when the engaging portions 4073 engage with the main body drive transmission surfaces 4101*b*, the drive transmitting member 4101*r* does not rotate until the protrusions EP of the output member 4101*q* abut against the wall surfaces EW2, and the output member 4101*q* rotates at the angle β1 (a predetermined amount) in the R2 direction (the positive rotation direction). In the above, the output member 4101*q* countering the restoring force of the spring member 4103 rotates in the R2 direction. As illustrated in FIG. 17C, since the protrusions EP abut against the wall surfaces EW2 when the output member 4101*q* has rotated angle β1 (the predetermined amount), after the above, the protrusions EP press the wall surfaces EW2. With the above, rotational driving force is transmitted to the drive transmitting member 4101*r*, and the drive transmitting member 4101*r* rotates in the R2 direction together with the output member 4101*q* in an integrated manner. Since the drive transmitting member 4101*r* directly receives force from the protrusions EP of the output member 4101*q*, the drive transmitting member 4101*r* exceeding the frictional force from the three engaging portions 4073 rotate in the R2 direction. Furthermore, as described above, since loads of the development roller 217 and the toner feed roller 220 are applied to the coupling member 4028, the drive transmitting member 4101*r* rotates in the R2 direction relative to the coupling member 4028. Accordingly, when the drive transmitting member 4101*r* rotates the predetermined amount or more, the three drive transmission grooves 4101*a* rotate to a position where the three engaging portions 4073 enter the three drive transmission grooves 4101*a*. In the above situation, the three engaging portions 4073 are at engageable positions that allow engagement with the main body drive transmission surfaces 4101*b* in the radial direction about the rotational axis of the drive transmitting member 4101*r*.

When the rotation is continued from the above, as illustrated in FIG. 17A, the three main body drive transmission surfaces 4101*b* engage with the three engaging portions 4073. With the above, the drive transmitting member 4101*r* and the coupling member 4028 rotate in the R2 direction (the positive rotation direction) in an integrated manner enabling the development roller 217 and the toner feed roller 220 to be rotated. While the drive transmitting member 4101*r* and the coupling member 4028 are rotated in the positive rotation direction as described above, an image can be formed on the recording material.

Furthermore, as illustrated in FIG. 17B, the main body drive transmission surfaces 4101*b* of the main body drive shaft 4101 are inclined against the radial direction of the main body drive shaft 4101 so as to bite into the engaging portions 4073 during the transmission of the drive. With the inclinations of the main body drive transmission surfaces 4101*b*, undercut shape portions UC hollowed in the positive rotation direction and the opposite direction (R1 direction) in which the drive transmitting member 4101*r* rotates are formed in the drive transmission grooves 4101*a* in the circumferential direction. Similarly, the driving force receiving surfaces 4073*a* of the coupling member 4028 are inclined in the radial direction of the coupling member 4028 so as to be parallel to the main body drive transmission surfaces 4101*b* and form undercut shape portions. By providing such undercut shape portions UC, when the driving force is transmitted from the main body drive shaft 4101 to the coupling members 4028, force that makes the main body drive shaft 4101 and the coupling member 4028 bite against each other acts thereon. Accordingly, the engaging portions 4073 of the coupling member 4028 are configured not to come off from the drive transmitting member 4101*r*. The amount of hollowness of the undercut shape portion UC when indicated by the angle of the main body drive shaft 4101 in the circumferential direction is angle γ1.

Figure 18A:
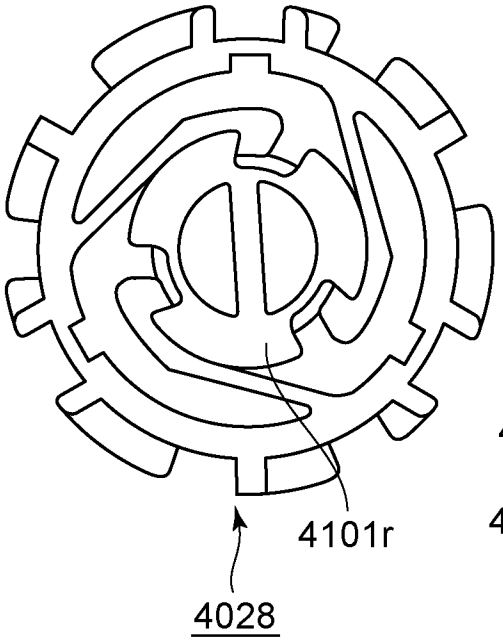
FIG. 18A is a diagram illustrating a relationship between the coupling member and the drive transmitting member.
Figure 18B:
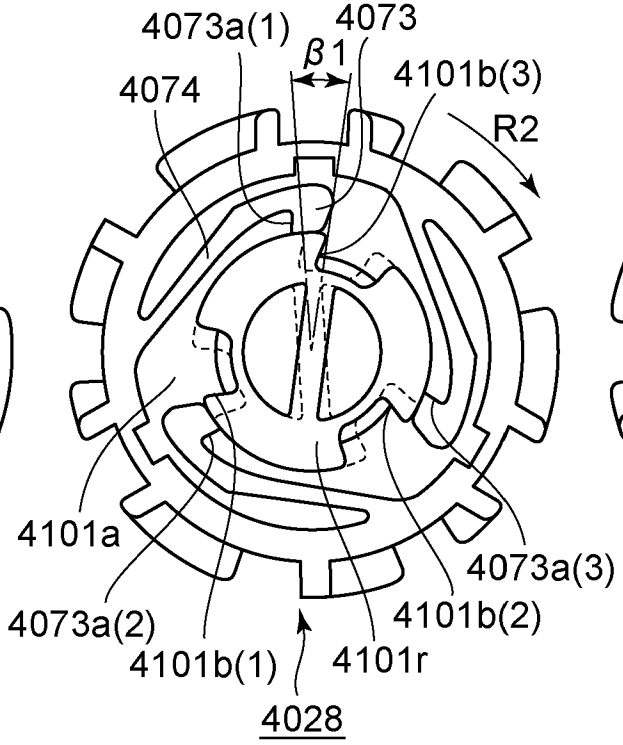
FIG. 18B is a diagram illustrating a relationship between the coupling member and the drive transmitting member.
Figure 18C:
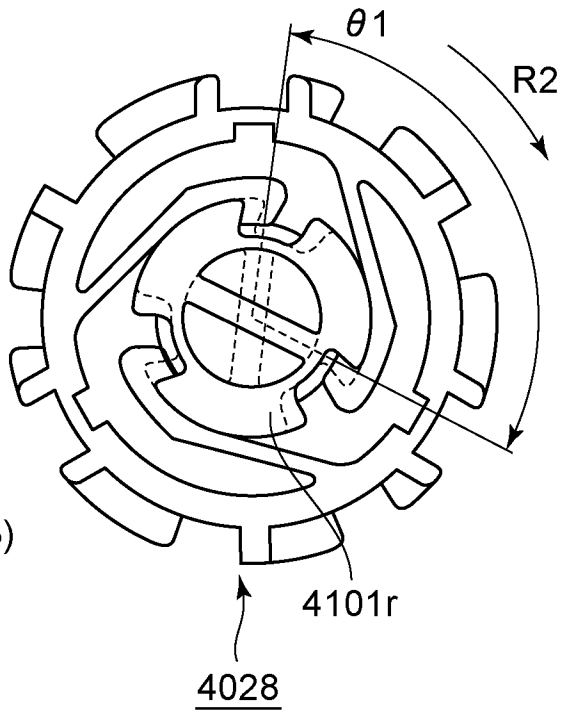
FIG. 18C is a diagram illustrating a relationship between the coupling member and the drive transmitting member.

Process of Engaging Coupling Member to Main Body Drive Shaft when Cartridge is Reinserted Referring next to FIGS. 8A to 8C, and 17A to 19, a case in which, after driving the developing cartridge 204, the user dismounts the developing cartridge 204 from the apparatus main body 1A and then inserts the same developing cartridge 204 inside the image forming apparatus main body 1A once again will be described. FIGS. 18A to 18C are diagrams illustrating a relationship between the coupling member 4028 and the drive transmitting member 4101*r* viewed in the axial direction of the main body drive shaft 4101. FIG. 18A illustrates a state in which the drive has been stopped after the coupling member 4028 had been driven with the drive transmitting member 4101*r*. FIG. 18B illustrates a state in which the developing cartridge 204 has been inserted inside the apparatus main body 1A again after the developing cartridge had been pulled out from the apparatus main body 1A. FIG. 18C illustrates a state after the drive transmitting member 4101*r* has been driven from the state illustrated in FIG. 18B.

As illustrated in FIG. 18A, when the drive is stopped after the coupling member 4028 has been driven with the drive transmitting member 4101*r*, all of the engaging portions 4073 of the coupling member 4028 are continuously in an engaged state with the main body drive transmission surfaces 4101*b* of the drive transmitting member 4101*r*. In the above state, the relationship between the drive transmitting member 4101*r* and the output member 4101*q* is also continuously in the state illustrated in FIG. 17C, and the protrusions EP are abutted against the wall surfaces EW2. From the above state, the user pulls out the developing cartridge 204 from the apparatus main body 1A and cancels the engagement between the drive transmitting member 4101*r* and the coupling member 4028. Then, with the restoring force of the spring member 4103, the drive transmitting member 4101*r* is rotated at angle β1 (the predetermined amount) in the R2 direction relative to the output member 4101*q*. Accordingly, as illustrated in FIG. 8C, the wall surfaces EW1 abut against the protrusions EP and the rotation of the drive transmitting member 4101*r* is stopped. The drive transmitting member 4101*r* rotates with the restoring force of the spring member 4103 because there are no loads of the development roller 217 and the toner feed roller 220 that have been applied to the drive transmitting member 4101*r* through the coupling member 4028 anymore.

A case in which the user inserts the same developing cartridge 204 into the apparatus main body 1A once again and positions the developing cartridge 204 in the apparatus main body 1A will be described next. When the same developing cartridge 204 is inserted once again into the apparatus main body 1A, in many cases, the rotational phase of the coupling member 4028 has been barely changed from the phase immediately before being pulled out from the apparatus main body 1A. The above is because, unless the user intentionally rotates the coupling member 4028, the coupling member 4028 does not rotate inside the developing cartridge 204 owing to the loads of the development roller 217 and the toner feed roller 220. Accordingly, when the same developing cartridge 204 is inserted and is positioned in the apparatus main body 1A once again, the state illustrated in FIG. 18B is reached. In other words, the three engaging portions 4073 are all disposed at positions that are different from the positions of any of the drive transmission grooves 4101*a*. The above state is the same as the state illustrated in FIG. 23 described above. Accordingly, by rotating the output member 4101*q* in the R2 direction by an angle θ1 with the motor (not shown), and after going through the process described above, the three engaging portions 4073 all engage with the drive transmitting member 4101*r* as illustrated in FIG. 18C. With the above, the driving force can be transmitted to the coupling member 4028.

Comparative Example

Figure 19:
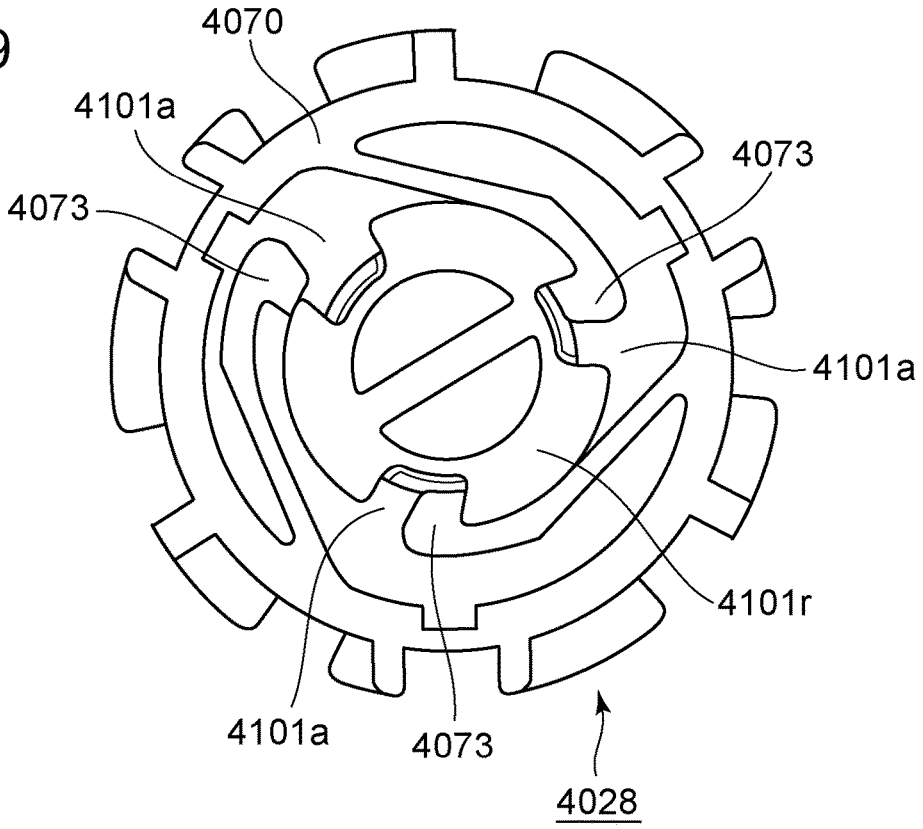
FIG. 19 is a diagram illustrating an incompletely engaged state of the coupling member and the drive transmitting member.

A case in which no spring member 4103 is provided between the drive transmitting member 4101*r* and the output member 4101*q* will be described as a comparative example. A case having a configuration of the comparative example in which the user, after driving the coupling member 4028 with the drive transmitting member 4101*r*, pulls out the developing cartridge 204 from the apparatus main body 1A and cancels the engagement between the drive transmitting member 4101*r* and the coupling member 4028 will be described. In such a case, since the spring member 4103 is not provided, after the engagement with the coupling member 4028 is released, the drive transmitting member 4101*r* does not rotate relative to the output member 4101*q*. Accordingly, there is a possibility that a state illustrated in FIG. 19 is reached when the user inserts the same developing cartridge 204 into the apparatus main body 1A once again and positions the developing cartridge 204 in the apparatus main body 1A. FIG. 19 is a diagram illustrating an incompletely engaged state of the coupling member 4028 and the drive transmitting member 4101*r*. In the state illustrated in FIG. 19, among the three engaging portions 4073, only some of the engaging portions 4073 have entered the drive transmission grooves 4101*a* and engaged with the main body drive transmission surfaces 4101*b*. The above has been affected by the position tolerance of the three driving force receiving surfaces 4073*a* and the three main body drive transmission surfaces 4101*b*. Such a state is an incompletely engaged state in which not all of the engaging portions 4073 are engaged with the main body drive transmission surfaces 4101*b*. When the drive transmitting member 4101*r* is rotated in such a state, since some of the engaging portions 4073 are engaged with the main body drive transmission surfaces 4101*b*, it is possible to transmit the driving force and rotate the coupling member 4028. However, since the drive transmitting load is concentrated to only some of the engaging portions 4073, some of the engaging portions 4073 may become damaged, the balance of the transmitted drive may be poor causing the coupling member 4028 to become eccentric, and drive transmission accuracy may become poor.

Effect of Present Exemplary Embodiment

In the present exemplary embodiment, from the state illustrated in FIG. 18A, the developing cartridge 204 is pulled out from the apparatus main body 1A and the engagement between the drive transmitting member 4101*r* and the coupling member 4028 is released. In such a case, with the restoring force of the spring member 4103, the drive transmitting member 4101*r* is rotated at angle β1 (the predetermined amount) in the R2 direction relative to the output member 4101*q* and stops after that. Note that the R2 direction is a direction in which the output member 4101*q*, the drive transmitting member 4101*r*, and the coupling 4028 rotate during image formation and is the positive rotation direction. Accordingly, even when the user inserts and positions the same developing cartridge 204 into the apparatus main body 1A, as illustrated in FIG. 18B, all of the three engaging portions 4073 are disposed at positions that are different from the positions of any one of the drive transmission grooves 4101*a*. In other words, since either of the main body drive transmission surfaces 4101*b* are disposed at positions that do not become engaged with any one of the three engaging portions 4073, the possibility of being in the incompletely engaged state illustrated in FIG. 19 can be reduced.

The relationship between angle β1 that is the angle at which the protrusions EP can relatively move between the wall surfaces EW1 and EW2, and the amount (angle) β1 of the hollowness of the undercut shape portion UC is expressed as $$\text{angle}\beta 1 > \text{angle}\beta 1.$$

By satisfying such a relationship, either of the main body drive transmission surfaces 4101*b* can be moved to positions not engaging with any one of the driving force receiving surfaces 4073*a*. In other words, after the engagement with the coupling member 4028 is released, the drive transmitting member 4101*r* is rotated in the R2 direction at angle β1 relative to the output member 4101*q*. With the above, all of the main body drive transmission surfaces 4101*b* can be, in the R2 direction, disposed upstream of the driving force receiving surfaces 4073*a* (the corresponding driving force receiving surfaces 4073*a*) that are to be engaged afterwards. Note that if the three main body drive transmission surfaces 4101*b* are 4101*b*(1), 4101*b*(2), and 4101*b*(3), then, the main body drive transmission surfaces 4101*b*(1) will later engage with the driving force receiving surface 4073*a*(1). Similarly, the main body drive transmission surfaces 4101*b*(2) and 4101*b*(3) will later engage with the driving force receiving surfaces 4073*a*(2) and 4073*a*(3), respectively.

In the present exemplary embodiment, the driving force receiving surfaces 4073*a* of the coupling member 4028 are one of the engaging portions that can be moved in the radial direction about the rotational axis of the drive transmitting member 4101*r* and that can be engaged with the main body drive transmission surfaces 4101*b* of the drive transmitting member 4101*r* that are the other engaging portions. However, the engaging configuration that transmits drive between the coupling member 4028 and the drive transmitting member 4101*r* is not limited to the above configuration. For example, the shape for engaging in the drive transmitting member 4101*r* and that in the coupling member 4028 may be switched. In other words, main body driving force transmitting surfaces such as the engaging portions 4073 movable in the radial direction may be formed in the drive transmitting member 4101*r*. Furthermore, grooves such as the drive transmission grooves 4101*a* may be formed in the coupling member 4028 and driving force receiving surfaces may be provided in the grooves.

As described above, with the present exemplary embodiment, the possibility of being in the incompletely engaged state illustrated in FIG. 19 can be reduced.

Second Exemplary Embodiment

Referring next to FIGS. 20 to 22C, a second exemplary embodiment of the present disclosure will be described. Note that components that are the same or components that have the same functions as those of the first exemplary embodiment will be denoted with the same reference numerals and description thereof will be omitted.

Figure 20:
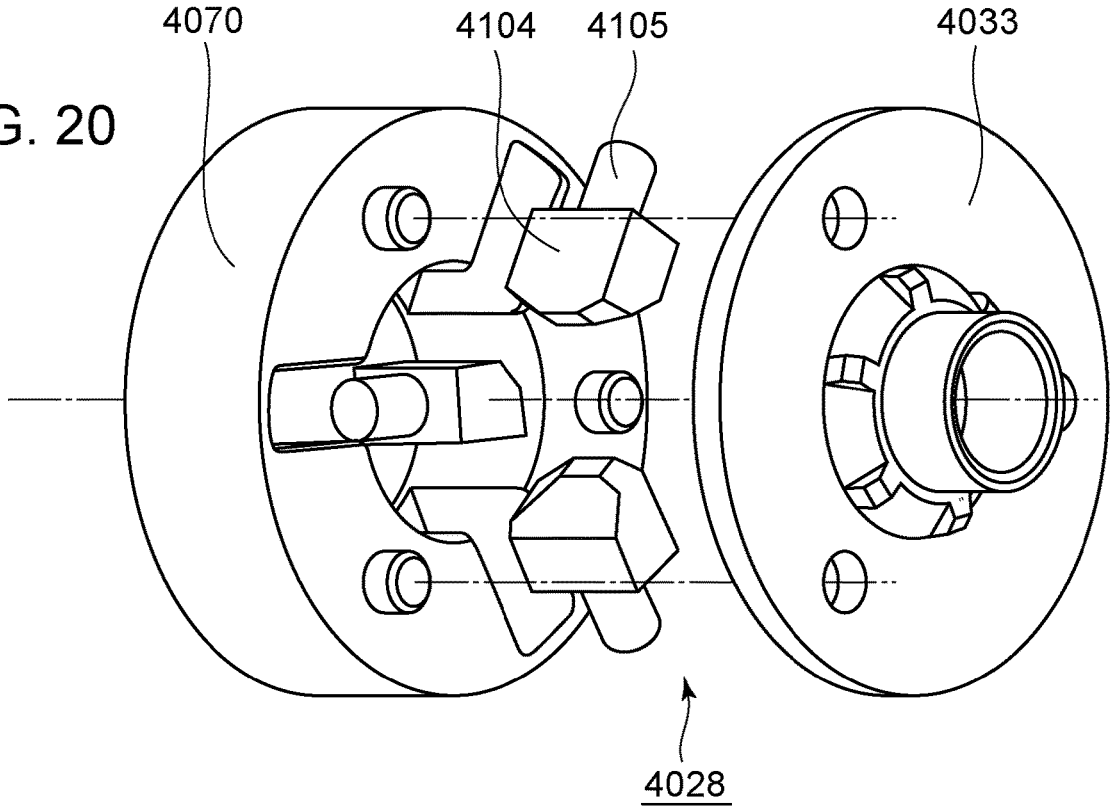
FIG. 20 is an exploded perspective view of the coupling member.

FIG. 20 is an exploded perspective view of a coupling member 4028. The coupling member 4028 is formed of two members, that is, a cylinder member 4070 and an aligning member 4033 combined together. However, depending on the material and the forming method, the coupling member 4028 does not have to be formed of two members but may be a single member, or may be a combination of three or more members. The aligning member 4033 is a positioning member that sets the position of the coupling member 4028 with respect to the drive transmitting shaft, and is a transmitted member to which driving force from the cylinder member 4070 is transmitted. Slide members 4104 and compression springs 4105 are incorporated inside the cylinder member 4070. The compression springs 4105 bias the slide members 4104 towards the rotation center of the cylinder member. Furthermore, the slide members 4104 are equidistantly disposed at three portions in a circumferential direction of the cylinder member 4070. In the present exemplary embodiment, three slide members are disposed in the circumferential direction; however, the slide members may be disposed at two portions or at four or more portions.

Figure 21B:
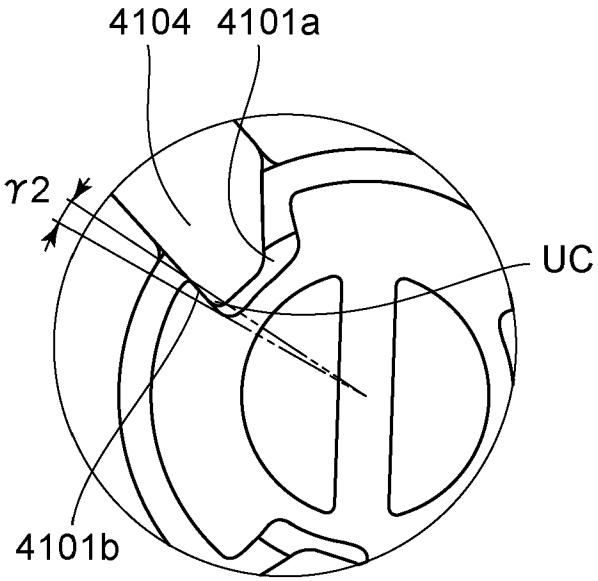
FIG. 21B is an enlarged view of a C2 portion in FIG. 21A.
Figure 21A:
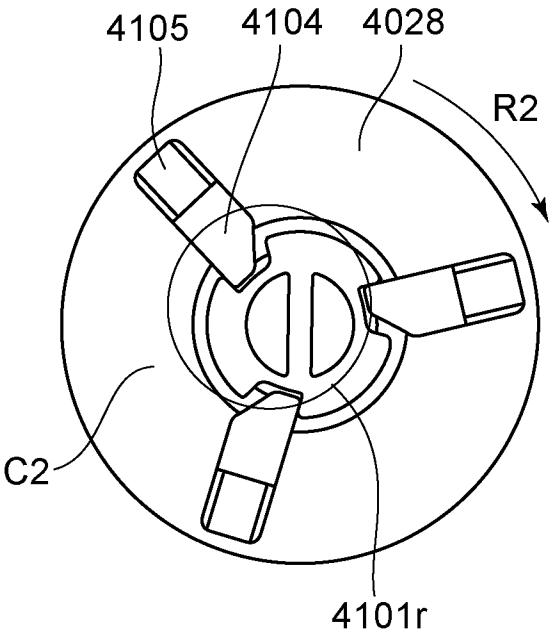
FIG. 21A is a diagram illustrating a relationship between the coupling member and the main body drive shaft.

FIG. 21A is a diagram illustrating a state after the drive has been transmitted to the coupling member 4028 from the main body drive shaft 4101. When the main body drive shaft 4101 starts to be driven, the coupling member 4028 receives force of the transmitted drive from the drive transmitting member 4101*r* and is rotated in the R2 direction. As illustrated in FIG. 21B, similar to the first exemplary embodiment, the main body drive transmission surfaces 4101*b* of the main body drive shaft 4101 and the driving force receiving surfaces 4073*a* of the coupling member 4028 each include the undercut shape portion UC having a hollowness of amount γ2. Accordingly, when driving force is transmitted, force acts on the two members in directions biting each other so that the slide member 4104 do not come off from the drive transmitting member 4101*r*.

Figure 22C:
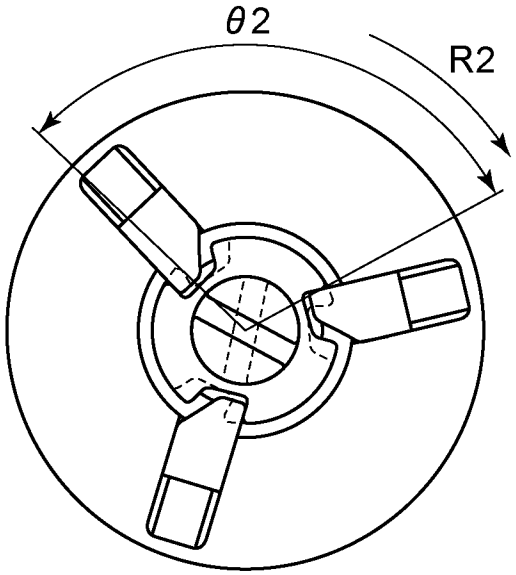
FIG. 22C is a diagram illustrating a relationship between the coupling member and the main body drive shaft.
Figure 22B:
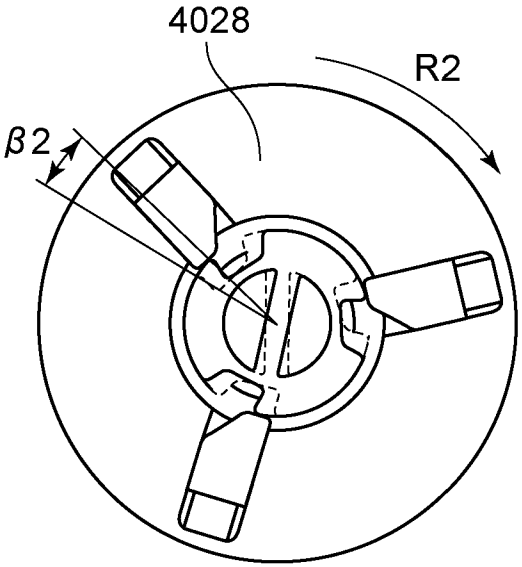
FIG. 22B is a diagram illustrating a relationship between the coupling member and the main body drive shaft.
Figure 22A:
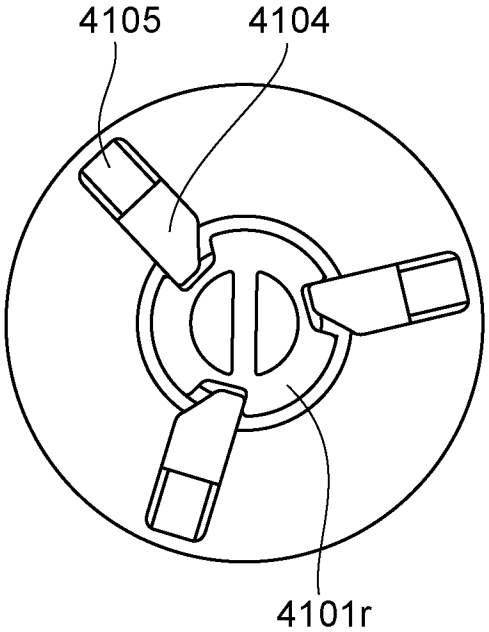
FIG. 22A is a diagram illustrating a relationship between the coupling member and the main body drive shaft.

FIG. 22A is a diagram illustrating a state immediately after when the drive has been transmitted to the coupling member 4028. FIG. 22B is a diagram illustrating a state immediately after when the developing cartridge, which had been pulled out, has been inserted into the main body once again. Furthermore, FIG. 22C is a diagram illustrating a state immediately after when drive has been applied to the coupling member 4028 from the state illustrated in FIG. 22B. When the developing cartridge is pulled out from the inside of the main body from a state (FIG. 22A) immediately after the drive has been transmitted to the coupling member 4028, similar to the first exemplary embodiment, the drive transmitting member 4101*r* receives biasing force in the rotation direction and is rotated in the R2 direction at angle β. In the above state, when the developing cartridge is inserted inside the main body, since the slide members 4104 and the drive transmission grooves 4101*a* are out of phase with respect to each other, the slide members 4104 retreat towards the outer side in the radial direction (FIG. 18B).

The angle β1 and the amount (angle) β2 of hollowness of the undercut shape portion UC is set so as to have the following relationship:

angleβ2>angleγ2.

The second exemplary embodiment is configured so that when the developing cartridge 204 is inserted once again, the three slide members 4104 move on the cylindrical portion 4101*f* and the slide members 4104 retreat towards the outer side in the radial direction. Furthermore, from the above state, when the drive transmitting member 4101*r* is driven, the drive transmitting member 4101*r* start to rotate in the R2 direction. At the point when the drive transmitting member 4101*r* has rotated about angle θ2, the first drive transmission groove 4101*a* on the downstream side in the rotation direction and the slide member 4104 engages with each other and the drive is transmitted to the coupling member 4028.

A similar effect can be obtained even with the second exemplary embodiment configured in the above manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-189096 filed Sep. 28, 2017, which is hereby incorporated by reference herein in its entirety.

What is claimed is:

1. An image forming apparatus that forms an image on a recording material, the image forming apparatus comprising:

a cartridge including a rotating member and a driving force receiving member that is rotatable together with the rotating member and is configured to receive driving force for rotating the rotating member; and an apparatus main body to which the cartridge is detachably attachable, the apparatus main body including, a driving force transmitting member configured to rotate about a rotational axis and transmit the driving force to the driving force receiving member, the driving force transmitting member rotating in a predetermined rotation direction during an image formation;

an output member rotatable and arranged coaxially with the driving force transmitting member, the output member being configured to transmit the driving force to the driving force transmitting member and to have play between itself and the driving force transmitting member in a rotation direction of the driving force transmitting member, and a biasing member disposed between the output member and the driving force transmitting member, the biasing member biasing the driving force transmitting member relative to the output member in the predetermined rotation direction, the biasing member biasing the driving force transmitting member toward the driving force receiving member of the cartridge in a direction of the rotational axis, wherein one of the driving force transmitting member and the driving force receiving member includes a plurality of engaging portions, and the other of the driving force transmitting member and the driving force receiving member includes a plurality of engaged portions, the plurality of engaging portions and the plurality of engaged portions engaging with each other so that the driving force transmitting member is capable of transmitting the driving force to the driving force receiving member, and wherein when an engagement between the driving force transmitting member and the driving force receiving member is released by a detachment of the cartridge from the apparatus main body, the driving force transmitting member is caused to rotate relative to the output member in the predetermined rotation direction by biasing force of the biasing member.

2. The image forming apparatus according to claim 1, wherein the plurality of engaged portions are a plurality of grooves formed on an outer circumferential surface of a shaft, and the plurality of engaging portions are a plurality of protrusions protruded from an inner circumferential surface of a cylindrical portion, the plurality of protrusions each being elastically movable in a radial direction of the cylindrical portion between an engaging position in which the protrusion gets into the groove and a non-engaging position in which the protrusion recedes from the groove in a state that the cartridge is attached to the apparatus main body.

3. The image forming apparatus according to claim 1, wherein the output member includes, a transmission portion configured to contact with the driving force transmitting member and that transmits the driving force, and a restricting portion configured to contact with the driving force transmitting member and configured to restrict the rotation of the driving force transmitting member about the rotational axis, wherein the play is a rotation amount of the output member by which the output member rotates between the transmission portion and the restricting portion of the driving force transmitting member, wherein while the driving force transmitting member and the driving force receiving member engage with each other so as to transmit the driving force from the driving force transmitting member to the driving force receiving member, the transmission portion of the output member is in contact with the driving force transmitting member and the restricting portion of the output member is not in contact with the driving force transmitting member, and wherein when the engagement between the driving force transmitting member and the driving force receiving member is released by the detachment of the cartridge from the apparatus main body, the driving force transmitting member is in contact with the restricting portion and the driving force transmitting member is not in contact with the transmission portion by a rotation of the driving force transmitting member in the predetermined direction due to the biasing force of the biasing member.

4. The image forming apparatus according to claim 1, wherein, in a case in which the cartridge that has been detached from the apparatus main body is re-mounted in the apparatus main body once again, when the output member is rotated in the predetermined rotation direction, the driving force transmitting member and the output member rotate in an integrated manner in the predetermined rotation direction after the output member has rotated relative to the driving force transmitting member in the predetermined rotation direction.

5. The image forming apparatus according to claim 1, wherein the rotating member is a developer carrying member that supplies developer to a photosensitive member.

6. The image forming apparatus according to claim 2, wherein when viewed in the direction of the rotational axis, the plurality of grooves each includes an undercut surface inclined toward the predetermined direction with respect to a radial direction of the shaft, and wherein the engaged portions are provided on surfaces in which the undercut shape portions are formed.

7. The image forming apparatus according to claim 1, wherein the biasing member is a helical compression spring having a first winding end and a second winding end opposite to the first winding end in a winding direction of the helical compression spring, and the first and second winding ends engage with the output member and the driving force transmitting member, respectively, thereby biasing the driving force transmitting member in the predetermined rotation direction relative to the output member, and the first and second winding ends are arranged at a region inside an inner diameter of the helical compression spring.

* * * * *